US009797190B2

(12) United States Patent
Zhang et al.

(10) Patent No.: US 9,797,190 B2
(45) Date of Patent: Oct. 24, 2017

(54) LOUVER ROLLER SYSTEM WITH AN INTERMITTENT GEAR TURNING MECHANISM

(71) Applicant: HANGZHOU WOKASOLAR TECHNOLOGY CO., LTD., Hangzhou, Zhejiang (CN)

(72) Inventors: Yifei Zhang, Hangzhou (CN); Chengshang Wu, Hangzhou (CN)

( * ) Notice: Subject to any disclaimer, the term of this patent is extended or adjusted under 35 U.S.C. 154(b) by 53 days.

(21) Appl. No.: 14/418,463

(22) PCT Filed: Jul. 28, 2013

(86) PCT No.: PCT/CN2013/080257

§ 371 (c)(1),
(2) Date: Jan. 30, 2015

(87) PCT Pub. No.: WO2014/019481

PCT Pub. Date: Feb. 6, 2014

(65) Prior Publication Data

US 2015/0211296 A1 Jul. 30, 2015

(30) Foreign Application Priority Data

Jul. 30, 2012 (CN) ..... 2012 1 0266070

(51) Int. Cl.
*E06B 9/322* (2006.01)
*E06B 9/303* (2006.01)

(52) U.S. Cl.
CPC ..... *E06B 9/322* (2013.01); *E06B 9/303* (2013.01)

(58) Field of Classification Search
CPC ..... E06B 9/322; E06B 9/303; E06B 9/307; E06B 9/308

(Continued)

(56) References Cited

U.S. PATENT DOCUMENTS 6,076,587 A * 6/2000 Pastor ..... E06B 9/307 160/115
6,845,802 B1 * 1/2005 Anderson ..... E06B 9/307 160/115

(Continued)

FOREIGN PATENT DOCUMENTS

CN 2525230 Y 12/2002
CN 2727374 Y 9/2005

(Continued)

OTHER PUBLICATIONS

International Search Report of PCT Patent Application No. PCT/CN2013/080257 dated Oct. 10, 2013.

*Primary Examiner* — Blair M Johnson
(74) *Attorney, Agent, or Firm* — Wayne & Ken, LLC; Tony Hom

(57) ABSTRACT

The invention discloses a louver roller system with an intermittent gear turning mechanism, comprising a base and a top cover, wherein a roller mechanism and an intermittent gear turning mechanism are mounted on the base, the roller mechanism is wound with ladder tapes, the roller mechanism is in axial connection with the intermittent gear turning mechanism, and the roller mechanism and the intermittent gear turning mechanism are driven to rotate by a square shaft. The roller mechanism controls horizontal rising and falling of secondary louver blades, and the roller within the roller mechanism rotates to wind or unwind the ladder tapes thereon and sequentially drives various secondary louver blades to rise and fall horizontally. When various secondary louver blades rise to a predetermined position, the intermittent gear turning mechanism drives a turning cylinder to rotate, so as to achieve turning of all louver blades.

17 Claims, 24 Drawing Sheets

(58) Field of Classification Search
USPC ..... 160/115, 116
See application file for complete search history.

(56) References Cited

U.S. PATENT DOCUMENTS

| | | | | |
|---|---|---|---|---|
| 7,913,738 | B2 * | 3/2011 | Fraser | E06B 9/322 160/115 |
| 8,281,843 | B2 * | 10/2012 | Yu | E06B 9/303 160/170 |
| 9,487,996 | B2 * | 11/2016 | Steenbergen | E06B 9/307 |
| 9,493,983 | B2 * | 11/2016 | Zhang | E06B 9/322 |
| 2003/0127197 | A1 | 7/2003 | Lai | |
| 2009/0314440 | A1 * | 12/2009 | Lai | E06B 9/303 160/170 |
| 2010/0071858 | A1 * | 3/2010 | Lai | E06B 9/307 160/170 |
| 2015/0211296 | A1 * | 7/2015 | Zhang | E06B 9/303 160/133 |

FOREIGN PATENT DOCUMENTS

| | | | |
|---|---|---|---|
| CN | 1795317 | A | 6/2006 |
| CN | 101818616 | A | 9/2010 |
| CN | 102071871 | A | 5/2011 |
| EP | 0684361 | A1 | 11/1995 |

* cited by examiner

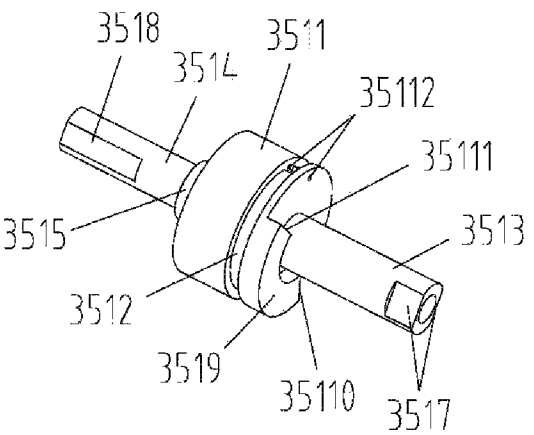
Fig.8a
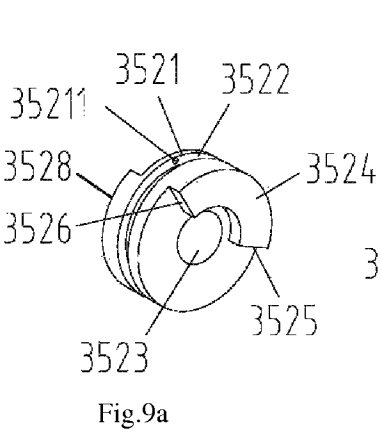
Fig.9a
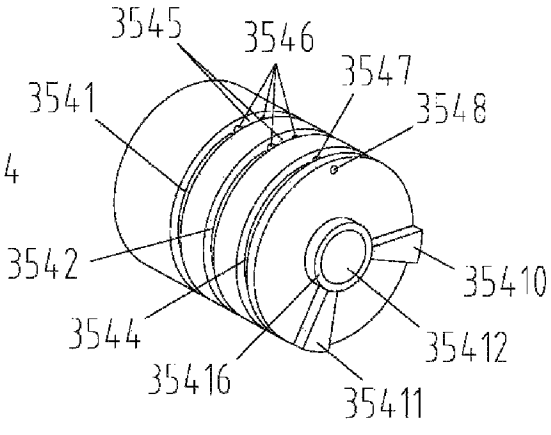
Fig.10a
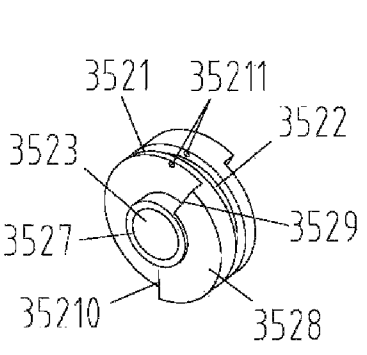
Fig.8b
Fig.9b
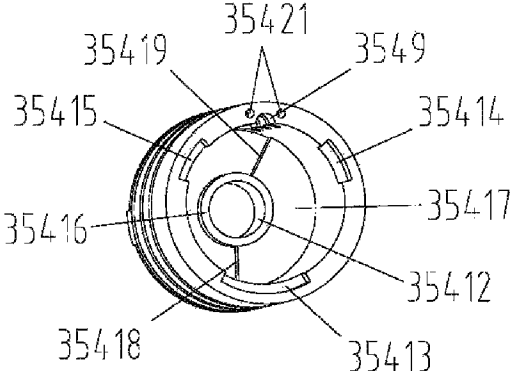
Fig.10b

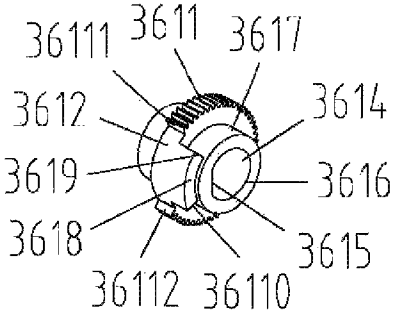
Fig.22a
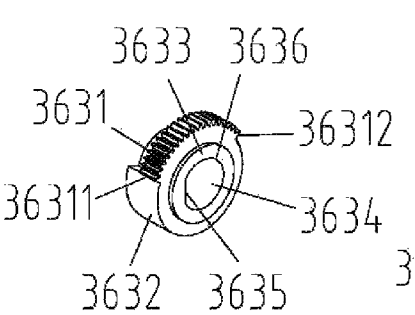
Fig.23a
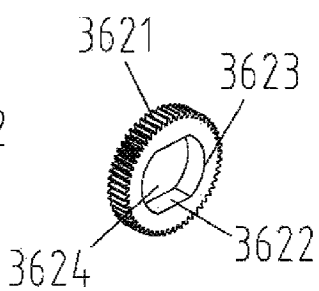
Fig.24a
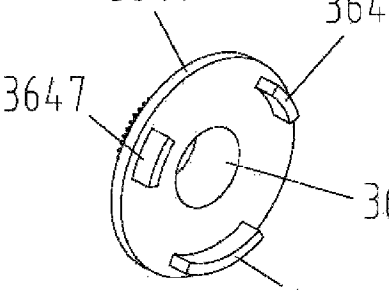
Fig.25a
Fig.22b
Fig.23b
Fig.24b
Fig.25b

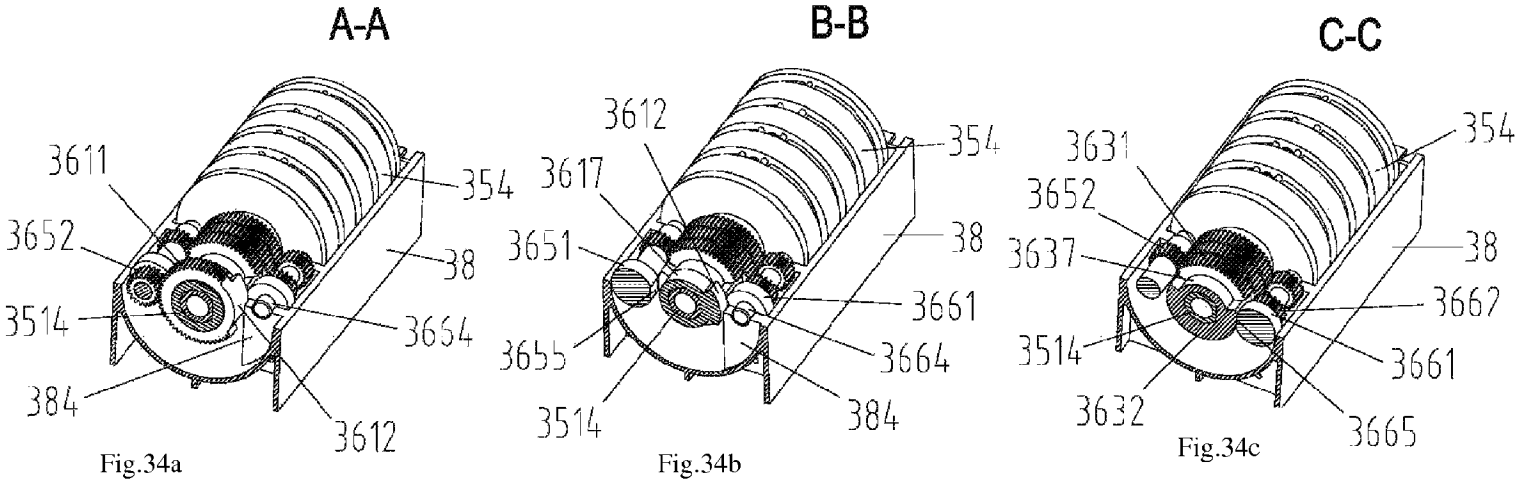
Fig.34a
Fig.34b
Fig.34c
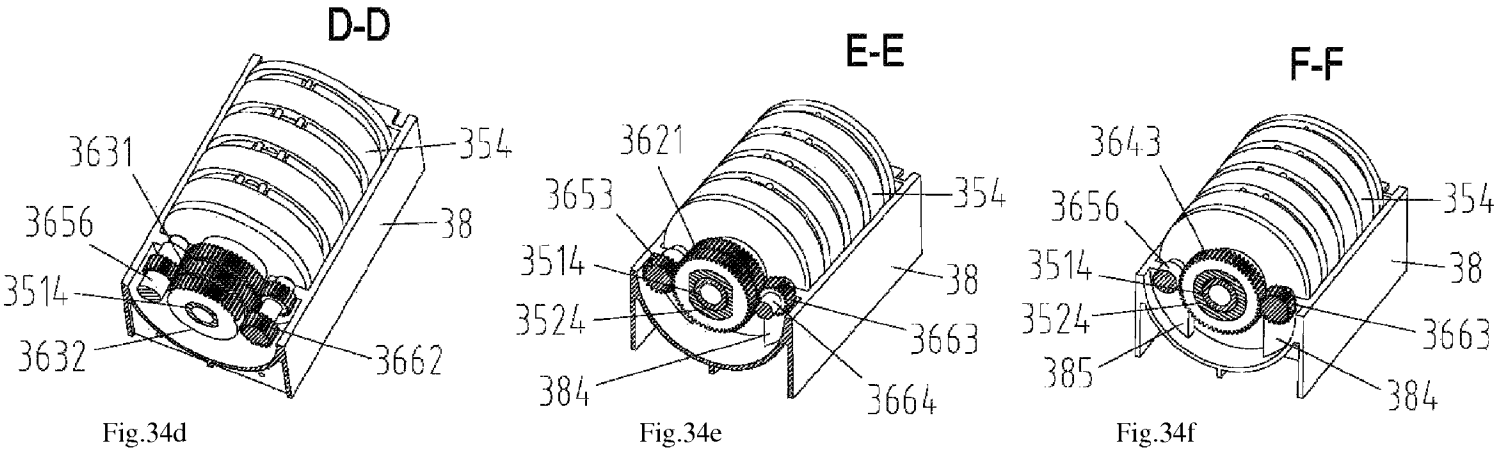
Fig.34d
Fig.34e
Fig.34f

LOUVER ROLLER SYSTEM WITH AN INTERMITTENT GEAR TURNING MECHANISM

FIELD OF THE INVENTION

The invention relates to a louver, in particular to a roller system of the louver.

BACKGROUND

Conventional louver consists of louver blades with arch-up cross sections, halyards, ladder tapes, a top rail and a base rail. A rotary actuator with self-locking function, a rotating shaft, several winding halyards and rollers for controlling the ladder tapes are installed in the top rail, the rotating shaft passes through the rotary actuator and the roller, there are ladder tapes between the top rail and the base rail, the lower ends of the ladder tapes are in fixed connection with the base rail, and two upper ends of the ladder tapes are butted and sheathed on the roller; a plurality of louver blades in parallel are put in the breast line of the ladder tape, a through hole is set at a symmetric center of the cross section of the louver blade to allow the halyard to pass through, the lower end of the halyard is in fixed connection with the base rail, and the upper end of the halyard is wound on the roller; the rotating shaft and the roller are driven to rotate by the rotary actuator, thus the louver blades can be lifted and turned; when the louver blades are folded, the halyards are wound to drive the base rail to rise, thus sequentially lifting up and folding the louver blades, and when the louver blades are unfolded, the halyards are unwound, and under the gravity of the base rail, the louver blades move down sequentially and are placed at an equal distance separated by the breast line of the ladder tape; when the base rail reaches the windowsill, the halyards are unwound completely, and when the rotary actuator continues to be pulled, the roller rotating together with the rotating shaft will turn the louver blades over under the action of frictional force, thus achieving the effect of adjusting indoor light. In practice, the roller for winding the halyards can also be replaced by a screw (see Utility Model ZL 02201583.3, Utility Model ZL 200420078400.6 and patent application Ser. No.: 200480014523.6), and the roller which drives the ladder tapes to rotate by virtue of frictional force or bayonet can also be replaced by a torsion spring or a snap spring wheel (see Patent Application No.: 200480014523.6).

One of critical defects of the conventional louver is that indoor daylight illumination could not be uniform. If the louver blades are turned and adjusted until the light near the window is moderate and glareless, the light deep into the interior is not enough, and it requires artificial lighting. If the louver blades are turned and adjusted until the light deep into the interior is moderate, the light near the window is glare. In addition, people only need moderate light, but no heat in summer, and people need both moderate light and heat in winter, however, for the purpose of reducing light and heat near the window, the louver blades of the conventional louver must be turned to the extent that the louver are almost closed whether in summer or in winter, which results in that the whole room is too dark, and appropriate indoor illumination should be maintained by artificial lighting whether in sunny day or cloudy day, thus causing enormous energy wastage and also reducing people's comfort and work efficiency. Therefore, in order to prevent glare and overheating near the window and give uniform daylight illumination deep into the interior, Chinese Patent Application (Application No.: 201010162501.1 and Application No.: 2010 1062 0508.3) discloses two combinatorial louver blades which can change space between louver blades, a combinatorial louver composed of such combinatorial louver blades would not change the path of light irradiating to the louver blades no matter whether the sun altitude H is greater or less than the shading angle of the louver, thus it can not only meet the requirement for preventing glare and overheating near the window, but also meet the requirement for uniform daylight illumination deep into the interior. Meanwhile, visual communication and air flow with outdoor spaces will not be affected. However, this patent application only disclosed the combinatorial structure of the combinatorial louver blades as well as shading and light guiding effects of relatively lifting and turning over the louver blade, and did not disclose a driving mechanism associated with such combinatorial louver.

The invention discloses a roller system for the above-mentioned louver. This roller system is also applicable to a new scheme (see examples below)—a combinatorial louver with more than three secondary louver blades, which is extended from the above inventions (201010162501.1 and 2010 1062 0508.3).

The pitch D referred to in the invention is the distance between two adjacent primary louver blades, the width L of the louver blade is the horizontal width of the cross section of the louver blade, the pitch ratio D/L is the ratio of the pitch D to the width L of the louver blade, $D_1$ is the vertical distance of a first secondary louver blade relative to a lower primary louver blade of two adjacent primary louver blades, $D_2$ is the vertical distance of a second secondary louver blade relative to a lower primary louver blade of two adjacent primary louver blades, $D_3$ is the vertical distance of a third secondary louver blade relative to a lower primary louver blade of two adjacent primary louver blades, and $\phi$ is an angle that the louver blade is turned from a horizontal position to a closed position.

SUMMARY OF THE INVENTION

Because no driving mechanism of such combinatorial louver exists in the prior art, for accomplishing above actions of the louver blades, the invention discloses a roller system for accomplishing above actions of the louver, which is mainly used for controlling rising of the secondary louver blades and turning of all louver blades.

In order to solve above technical challenges, the invention solves by the following technical solutions:

The louver roller system with an intermittent gear turning mechanism comprises a base and a top cover, a roller mechanism and a turning mechanism are mounted on the base, the roller mechanism is wound with ladder tapes, the roller mechanism is in axial connection with the turning mechanism, and the roller mechanism and the turning mechanism are driven to rotate by a square shaft; the roller mechanism controls horizontal rising and falling of secondary louver blades, a roller is set within the roller mechanism, the roller is wound with ladder tapes, and the ladder tapes are connected with the louver blades; when rotating, the roller drives the ladder tapes thereon to wind or unwind, so as to achieve horizontal rising or falling of various secondary louver blades, and when various secondary louver blades rise to a predetermined position, the turning mechanism achieves turning of all louver blades.

Preferably, the roller mechanism comprises a turning cylinder, at least one roller is set within the turning cylinder, and the roller is set on a hollow rotating shaft which passes through a turning disc on an open end surface of the turning cylinder and is connected with an intermittent gear, one side of the intermittent gear is meshed with a driven gear, the driven gear is also meshed with a fixed gear in the center of the turning disc, and the intermittent gear and the driven gear constitute the turning mechanism. The roller within the turning cylinder is driven to rotate by the square shaft in the hollow rotating shaft, when the intermittent gear on the hollow rotating shaft starts to rotate, it is not meshed with the driven gear, and when it rotates to a certain angle, namely the internal roller drives the secondary louver blades to rise to a predetermined position, the intermittent gear is meshed with the driven gear, and the driven gear is meshed with the fixed gear in the center of the turning disc, resulting that the turning disc drives the turning cylinder to mesh, so as to achieve turning of all blades connected to the turning cylinder.

Preferably, one end of the turning cylinder is an open end surface and the other end is a closed end surface, annular grooves are set on an outer ring surface of the turning cylinder, a hole is set on the top of each of the annular grooves and pin shafts are mounted on both sides of the hole, the annular grooves are respectively wound with secondary ladder tapes, upper ends of the front and rear cords of the secondary ladder tape pass through a hole between two pin shafts of the annular grooves, go into the turning cylinder (354) and get fixed connection with the roller, a pin hole is set on the top of the annular groove, the annular groove is wound with a primary ladder tape, and upper ends of the front and rear cords of the primary ladder tape are fixed on the top of the annular groove through the pin shaft; sector bulges are axially held out from an outer wall of a closed end surface of the turning cylinder, for controlling rotation angle of the turning cylinder, when turning cylinder rotates to the sector step and touches a base bulge, it does not continue to rotate any more, and when the turning cylinder rotates reversely, an annular bulge axially held out from an inner wall of the closed end surface of the turning cylinder acts on a second secondary roller and allows the second secondary roller to rotate reversely to drive the second secondary louver blade to return to a horizontal position.

Preferably, an annular disc of the first secondary roller is set on the hollow rotating shaft, one side of the annular disc is planar, and a sector bulge is axially held out from the other side of the annular disc; and sector bulges are axially held out from both sides of the annular disc of the second secondary roller.

Preferably, one side of the turning disc is planar and three sector convex platforms are set thereon, and a gear with a journal is set on the other side of the turning disc.

Preferably, the outer ring surface of the intermittent gear comprises two portions: a toothed portion and an arc surface. When the arc surface of the intermittent gear is touched with the locking arc of the driven gear, both gears does not interact with each other without the effect of meshing for power transmission, and when it rotates to the toothed portion of the intermittent gear, it is meshed with the driven gear to transmit the power.

Preferably, the driven gear comprises at least one gear and further comprises a disc with a locking arc. When the locking arc is touched with the toothless arc surface of the intermittent gear, both gears does not transmit power.

Preferably, a first secondary roller and a second secondary roller are set within the turning cylinder, the second secondary roller is sheathed on the hollow rotating shaft of the first secondary roller, the hollow rotating shaft passes through the turning disc and is jogged with an inner ring of a first secondary gear, a driven gear is set beside the first secondary gear, and the driven gear is meshed with the first secondary gear and a fixed gear in the center of the turning disc; the hollow rotating shaft of the first secondary roller is driven to rotate by the square shaft, the first secondary roller drives a first secondary louver blade to rise by winding the secondary ladder tapes fixed thereon, and after the first secondary louver blade rises $D_1-D_2$, the sector bulge on the side of the first secondary roller pushes the sector bulge on the side of the second secondary roller and drives the second secondary roller to rotate; and the second secondary roller drives a second secondary louver blade to rise with the first secondary louver blade by winding or unwinding the secondary ladder tapes fixed thereon, the first secondary gear rotates with the hollow rotating shaft, and after the second secondary louver blade rises $D_2$, the first secondary gear drives the turning disc and the turning cylinder to rotate through the driven gear, so as to achieve turning of all louver blades. When the secondary louver blades rise, namely the hollow rotating shaft starts to rotate, the first secondary gear on the hollow rotating shaft rotates together, and because the arc surface of the outer ring of the first secondary gear is touched with the locking arc of the driven gear with out power transmission at this point, the both gears are not meshed. When the second secondary blade rises to a predetermined position, the first secondary gear rotates from the arc surface of the outer ring to the toothed portion, at this point, the first secondary gear is meshed with the driven gear, the driven gear drives the fixed gear in the center of the turning disc to rotate, and the turning disc drives the turning cylinder to rotate. The hollow rotating shaft of the first secondary roller in the invention passes through the turning disc without connection relationship, the first secondary gear and the hollow rotating shaft rotate simultaneously, and the turning disc is jogged with the turning cylinder together.

Preferably, a first secondary roller, a second secondary roller and a third secondary roller are set within the turning cylinder, the second secondary roller and the third secondary roller are sheathed on the hollow rotating shafts on both sides of the first secondary roller, the hollow rotating shaft passes through the turning disc, the second secondary gear and the intermittent gear which comprises the first secondary gear (361) and the third secondary gear, the second secondary gear is fixed on the hollow rotating shaft of the second secondary roller, the first secondary gear and the third secondary gear are fixed on the hollow rotating shaft of the first secondary roller, there are driven gears set on both sides of the intermittent gear, and the driven gear comprises a second secondary driven gear and a third secondary driven gear; the hollow rotating shaft is rotated by the square shaft and drives the first secondary roller, the first secondary gear and the third secondary gear to rotate, the second secondary gear achieves synchronous rotation of an angle with the first secondary gear through the second secondary driven gear, namely the second secondary gear drives the second secondary roller to rotate synchronously with the first secondary roller, and stops rotating after driving the second secondary louver blade to rise $D_2$ synchronously with the first secondary louver blade by winding the secondary ladder tapes fixed thereon, and the gear on the turning disc rotates together after achieving rotation of an angle for the third secondary gear through the third secondary driven gear, namely when the first secondary roller drives the first secondary louver blade to rise $D_2+D_3$ by winding the secondary ladder tapes fixed thereon, the turning disc drives the whole turning cylinder to rotate, so as to achieve turning of all louver blades.

Preferably, the driven gear described above comprises a second secondary driven gear and a third secondary driven gear, and the second secondary driven gear and the third secondary driven gear comprise two gears and a disc with a locking arc, respectively, one gear of the second secondary driven gear is meshed with the second secondary gear (362), and the other gear is meshed with the first secondary gear, and one gear of the third secondary driven gear is meshed with the fixed gear of the turning disc, and the other gear is meshed with the third secondary gear.

The roller system for the above-mentioned louver according to the technical solutions of the invention can control rising of the secondary louver blades and turning of all louver blades.

DESCRIPTION OF DRAWINGS

FIG. 8 is a three-dimensional diagram of a first secondary roller of the roller mechanism of the roller system 3 of the pitch-variable combinatorial louver with two secondary louver blades.

FIG. 9 is a three-dimensional diagram of a second secondary roller of the roller mechanism of the roller system 3 of the pitch-variable combinatorial louver with two secondary louver blades.

FIG. 10 is a three-dimensional diagram of a turning cylinder of the roller mechanism of the roller system 3 of the pitch-variable combinatorial louver with two secondary louver blades.

FIG. 22 is a three-dimensional diagram of a first secondary gear of the roller system 3 of the pitch-variable combinatorial louver with three secondary louver blades (dual binary pitch).

FIG. 23 is a three-dimensional diagram of a second secondary gear of the roller system 3 of the pitch-variable combinatorial louver with three secondary louver blades (dual binary pitch).

FIG. 24 is a three-dimensional diagram of a third secondary gear of the roller system 3 of the pitch-variable combinatorial louver with three secondary louver blades (dual binary pitch).

FIG. 25 is a three-dimensional diagram of a turning disc of the roller system 3 of the pitch-variable combinatorial louver with three secondary louver blades (dual binary pitch).

FIG. 30 is a three-dimensional diagram of a third secondary roller of the roller system 3 of the pitch-variable combinatorial louver with three secondary louver blades (dual binary pitch).

FIG. 31 is a three-dimensional diagram of a turning cylinder of the roller system 3 of the pitch-variable combinatorial louver with three secondary louver blades (dual binary pitch).

DETAILED DESCRIPTION OF PREFERRED EMBODIMENTS

Figure 1:
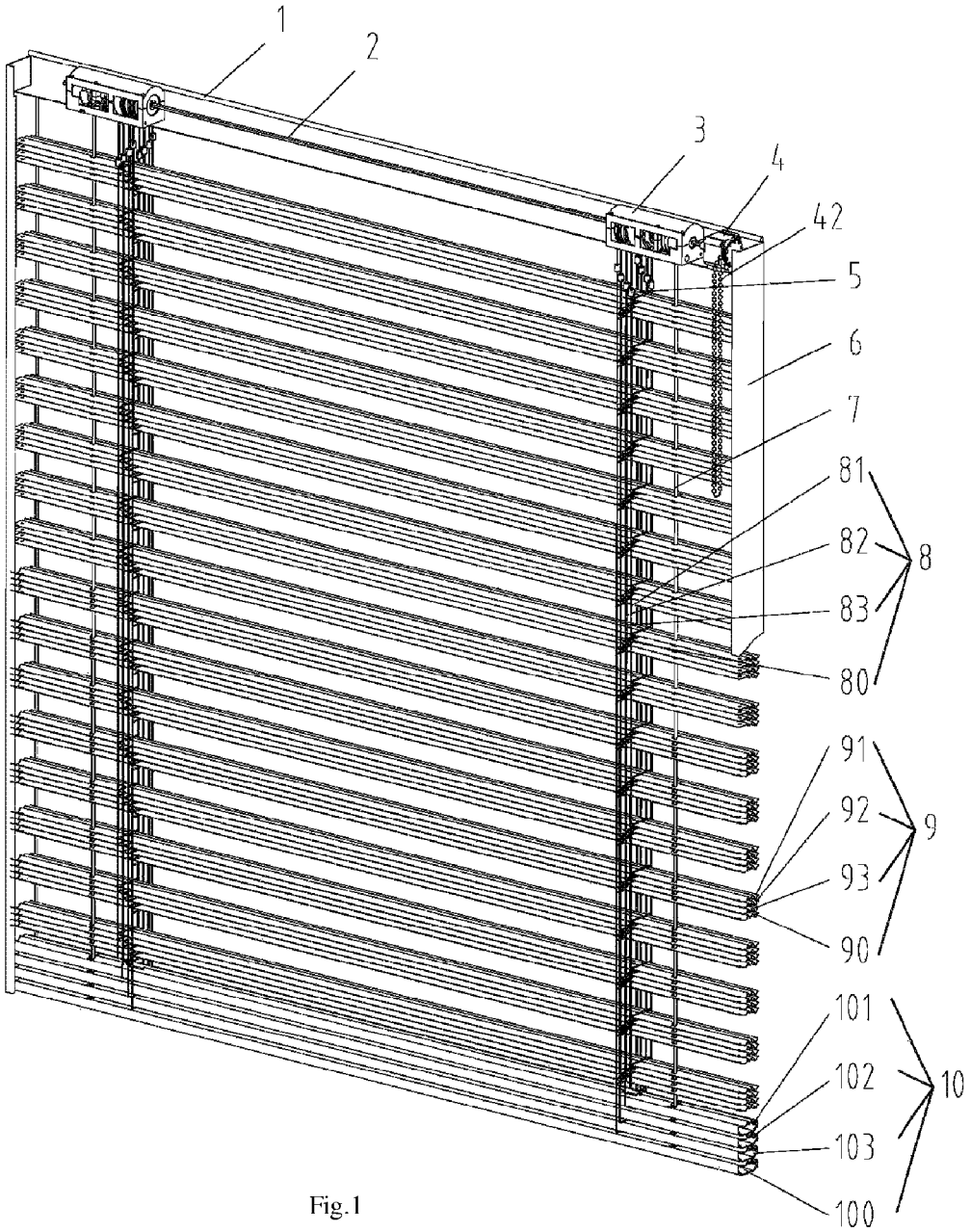
FIG. 1 is a three-dimensional diagram of a pitch-variable combinatorial louver with three secondary louver blades.
Figure 14:
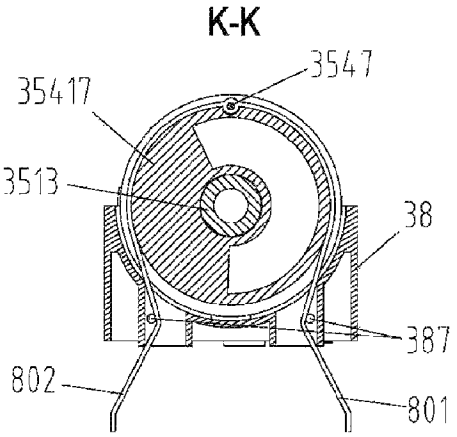
FIG. 14 is a K-K sectional view of the connection type between the roller system 3 of the pitch-variable combinatorial louver with two secondary louver blades and the primary ladder tapes.
Figures 30A, 30B, 31A, 31B, 32:
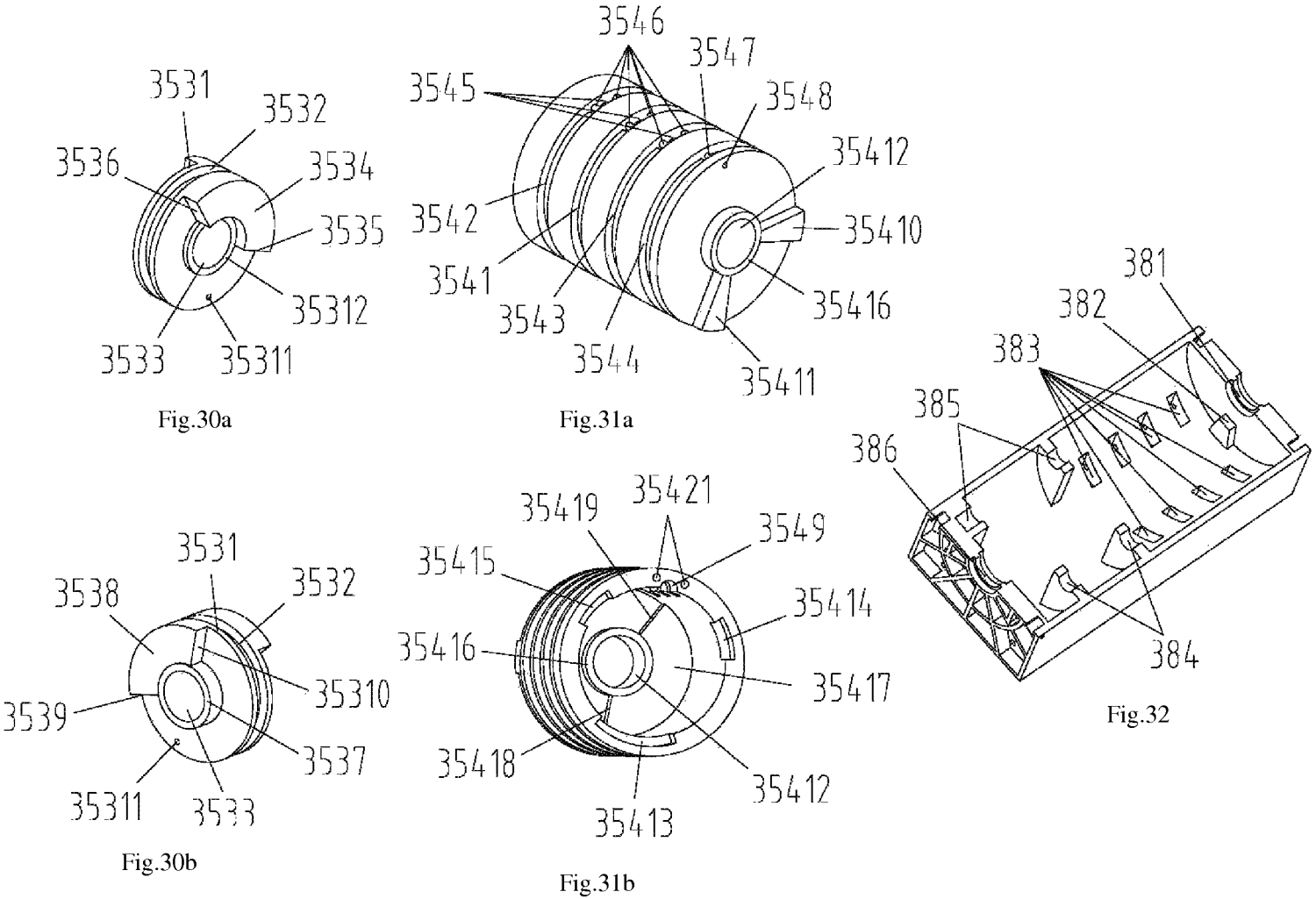
FIG. 32 is a three-dimensional diagram of a base of the roller system 3 of the pitch-variable combinatorial louver with three secondary louver blades (dual binary pitch).
Figure 33:
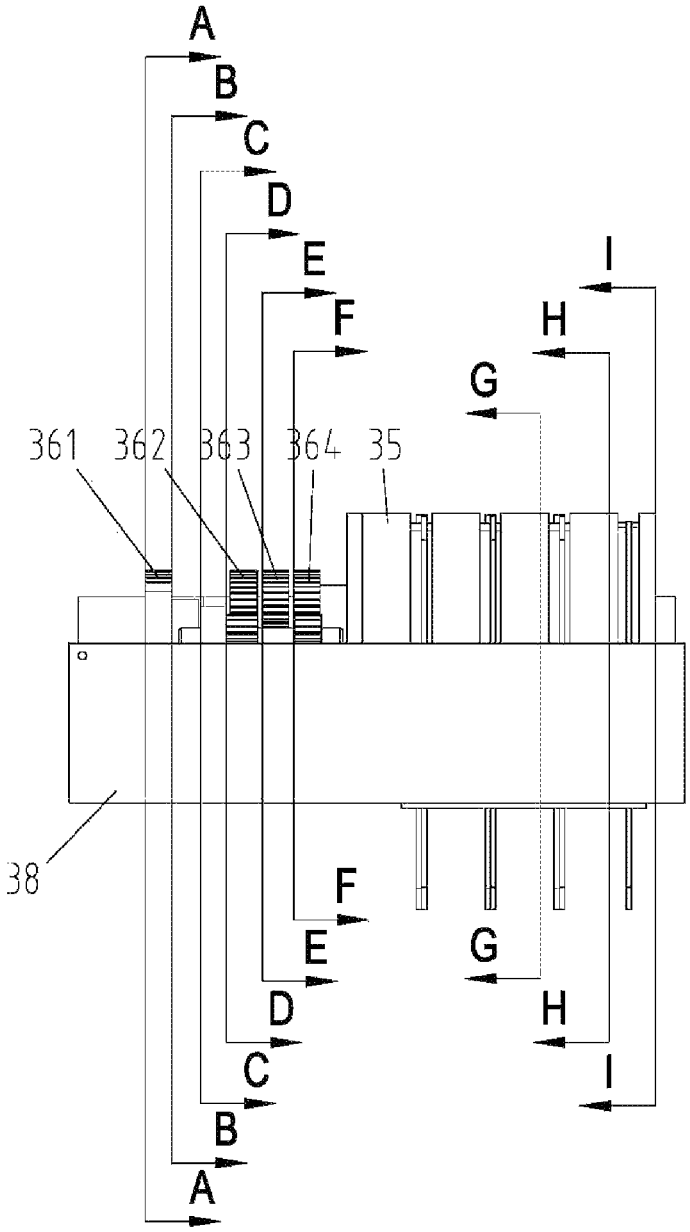
FIG. 33 is a schematic diagram of profile positions of the roller system 3 of the pitch-variable combinatorial louver with three secondary louver blades (dual binary pitch).

The invention will be further described in detail in conjunction with the drawings and specific embodiments, below:

The invention will be further described in detail in conjunction with FIG. 1-40 and specific embodiments, below:

FIG. 1 shows a pitch-variable combinatorial louver with three secondary louver blades (from the inside out), comprising a top rail 1, six square shafts 2, a roller system 3, an actuator 4, a cord connector 5, a side rail 6, a halyard 7, a ladder tape group 8, a louver blade group 9 and a base rail group 10. Taking the pitch-variable combinatorial louver with three secondary louver blades as an example, the ladder tape group 8 comprises the primary and secondary ladder tapes 8X (the primary ladder tape 80, the first secondary ladder tape 81, the second secondary ladder tape 82 and the third secondary ladder tape 83); the louver blade group 9 comprises the primary and secondary louver blades 9X (the primary louver blade 90, the first secondary louver blade 91, the second secondary louver blade 92 and the third secondary louver blade 93); and the base rail group 10 comprises the primary and secondary base rail 10X (the primary base rail 100, the first secondary base rail 101, the second secondary base rail 102 and the third secondary base rail 103). The actuator 4 and the roller system 3 are placed in the top rail 1, generally the actuator 4 is placed on the right end of the top rail 1, and the louver usually needs two roller systems 3; six square shafts 2 pass through the actuator 4 and the roller system 3 to connect the both together, and if a bead chain 42 on the actuator 4 is pulled, six square shafts 2 can be rotated by the actuator 4, so as to rotate the roller system 3 to rotate. The halyard 7 passes through the louver blade group 9, its upper end is connected with the lifting wheel 33 in the roller system 3, and its lower end is connected with the primary base rail 100; and upper ends of the front and rear cords 8X1 and 8X2 of the secondary ladder tapes 8X pass through a ladder tape hole 383 (as shown in FIG. 32) of the base 38 of the roller system 3 and are embedded in annular grooves 3541, 3542 and 3543 of the turning cylinder 354 of the roller mechanism 35 of the roller system 3, then go into a hole 3546 on its top and are connected with the secondary roller 35X (the first secondary roller 351, the second secondary roller 3512 and the third secondary roller 353). The primary and secondary louver blades 9X are pulled into the space between the upper and lower breast lines 8X11 and 8X12 of the primary and secondary ladder tapes 8X, both lower ends of the front and rear cords 8X1 and 8X2 of the primary and secondary ladder tapes 8X are fixed on the primary and secondary base rail 10X, and when the primary louver blade 90 and the secondary louver blades 9X turn over together (as shown in FIG. 40*d*), upper ends of the front and rear cords 801 and 802 of the primary ladder tape 80 are fixed on the pin shaft 3547 of the annular groove 3544 of the turning cylinder 354 of the roller system 3 (as shown in FIG. 14). The order in which the louver blades of the louver blade group are superposed is as follows: the first secondary louver blade 91 is on the top, the second secondary louver blade 92 is below the first secondary louver blade 91, the third secondary louver blade 93 is below the second secondary louver blade 92, and the primary louver blade is on the bottom. The order in which the base rails of the base rail group are superposed is as follows: the first secondary base rail 101 is on the top, the second secondary base rail 102 is below the first secondary base rail 101, the third secondary base rail 103 is below the second secondary base rail 102, and the primary base rail is on the bottom. The side rail 6 is placed on two ends of the blade group 9 and the base rail group 10, two ends of the blade group 9 and the base rail group 10 extend into a groove of the side rail 6 and can slide up and down, to avoid wind shaking of the blade group 9 and the base rail group 10. The critical component of the driving mechanism of the pitch-variable combinatorial louver is the roller system for controlling relative lifting of the secondary louver blades and turning of all blades.

Example 1

Turning Cylinder with Two Rollers Mounted therein, a Structure with Two Secondary Louver Blades.

A movement cycle of relative lifting and turning of combinatorial louver blades of the pitch-variable combinatorial louver with two secondary louver blades is as follows: (1) the primary louver blade 90 is spread over the louver at an equal space, and the secondary louver blades 91 and 92 are superposed on the primary louver blade 90 (corresponding to FIG. 39*a*); (2) the first secondary louver blade 91 rises to the position $D_1$–$D_2$ relative to the primary louver blade 90, and the second secondary louver blade 92 is still superposed on the primary louver blade 90 (corresponding to FIG. 39*b*); (3) the first secondary louver blade 91 continues to rise to the position $D_1$ relative to the primary louver blade 90, and meanwhile the second secondary louver blade 92 rises to the position $D_2$ relative to the primary louver blade 90 (corresponding to FIG. 39*c*); (4) the primary and secondary louver blades 90, 91 and 92 simultaneously rotate $\phi$ from a horizontal position to close the louver (corresponding to FIG. 39*d*); (5) the primary and secondary louver blades 90, 91 and 92 simultaneously turn back $\phi$ to the horizontal position (corresponding to FIG. 39*c*); (6) the first secondary louver blade 91 and the second secondary louver blade 92 fall $D_2$ relative to the primary louver blade 90, at this point the second secondary louver blade 92 is superposed on the primary louver blade 90 (corresponding to FIG. 39*b*); and (7) the first secondary louver blade 91 falls $D_1$–$D_2$ relative to the primary louver blade 90, until it is superposed on the second secondary louver blade 92 (corresponding to FIG. 39*a*), here D/L is set to be 1.2, $D_1$=2D/3, and $D_2$=D/3.

Figure 3:
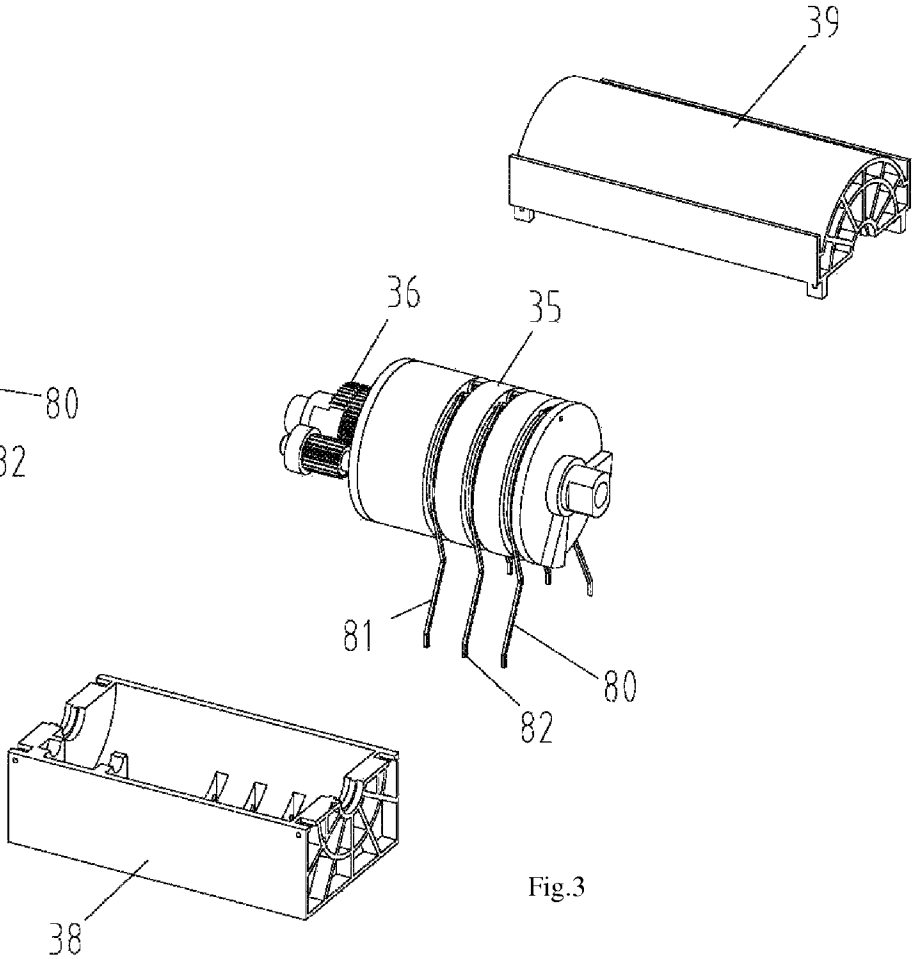
FIG. 3 is a three-dimensional explosive diagram of a roller system 3 of the pitch-variable combinatorial louver with two secondary louver blades.
Figure 2:
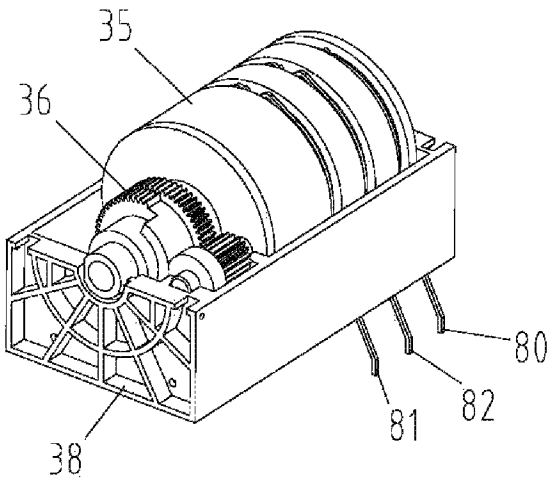
FIG. 2 is a three-dimensional assembly drawing of a roller system 3 of the pitch-variable combinatorial louver with two secondary louver blades.
Figure 5A:
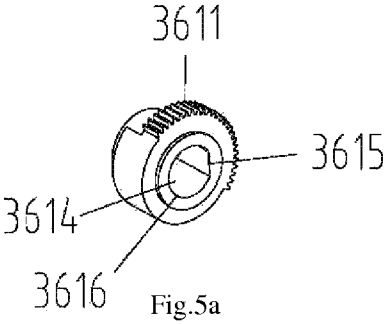
FIG. 5 is a three-dimensional diagram of an intermittent gear of the turning mechanism of the roller system 3 of the pitch-variable combinatorial louver with two secondary louver blades.
Figure 5B:
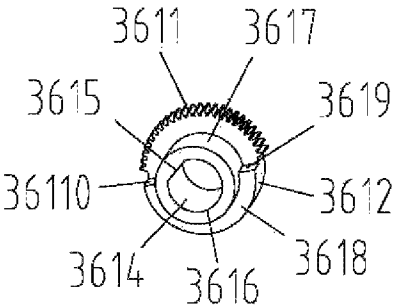

According to FIGS. 2, 3 and 5, the roller for the pitch-variable combinatorial louver with two secondary louver blades comprises a roller mechanism 35 and a turning mechanism 36, the roller mechanism 35 comprises a first secondary roller 351, a second secondary roller 352 and a turning cylinder 354, the first secondary roller 351 and the second secondary roller 352 are mounted in the turning cylinder 354, and the turning mechanism 36 comprises a first secondary gear 361, a driven gear 365 and a turning disc 364 which are axially connected.

FIG. 5 is a three-dimensional diagram of the first secondary gear 361 of the turning mechanism 36. The first secondary gear 361 is an intermittent gear, the toothed portion in the outer ring of the first secondary gear 361 is 3611, and an outer ring arc surface of the first secondary gear 361 is the outer ring arc surface 3612. The shape of the inner ring 3614 of the first secondary gear 361 is formed by intersecting of a planar surface 3615 with an arc surface 3616, an annular convex platform is set on one side of the first secondary gear 361, and an annular convex platform 3617 and a semi-annular bulge 3618 are axially held out from the other side of the first secondary gear 361, the outer ring of the annular convex platform 3617 is connected with the inner ring of the semi-annular bulge 3618, and the outer ring of the semi-annular bulge 3618 is the extension of the toothless outer ring arc surface 3612 of the first secondary gear 361.

Figure 6A:
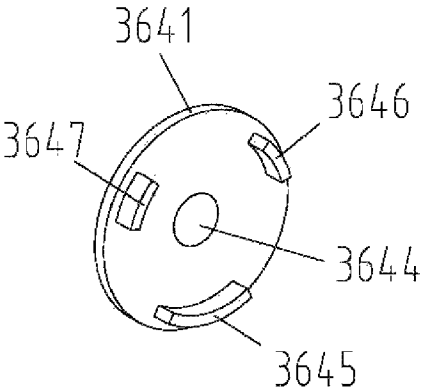
FIG. 6 is a three-dimensional diagram of a turning disc of the turning mechanism of the roller system 3 of the pitch-variable combinatorial louver with two secondary louver blades.
Figure 6B:
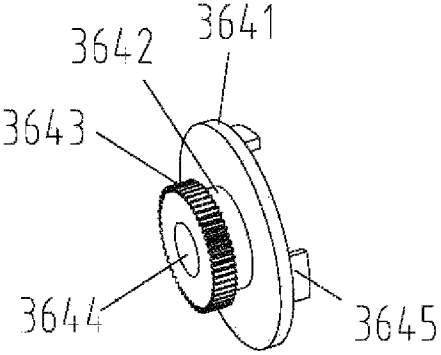

FIG. 6 is a three-dimensional diagram of the turning disc 364 of the turning mechanism 36. The turning disc 364 is an annular disc 3641 with an inner ring 3644, one side of the annular disc 3641 is planar, three sector bulges 3645 are set thereon, and teeth 3643 with a journal 3642 are set on the other side of the annular disc 3641.

Figure 7A:
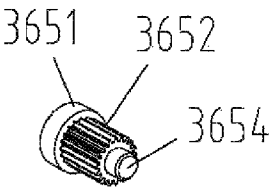
FIG. 7 is a three-dimensional diagram of a driven gear of the turning mechanism of the roller system 3 of the pitch-variable combinatorial louver with two secondary louver blades.
Figure 7B:
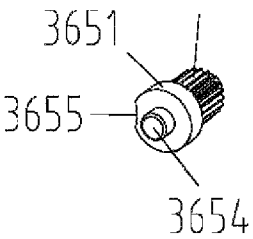

FIG. 7 is a three-dimensional diagram of the driven gear 365 of the turning mechanism 36. The driven gear 365 consists of a rotating shaft 3654 which passes through the teeth 3652 and a disc 3651 with a locking arc 3655.

FIG. 8 is a three-dimensional diagram of the first secondary roller 351 of the roller mechanism 35. The first secondary roller 351 is an annular disc 3511, an annular groove 3512 is set in the outer ring of the annular disc 3511, a hollow rotating shaft 3514 is axially held out from one side of the annular disc 3511, an axial step 3515 is set at the junction of the annular disc 3511 and the hollow rotating shaft 3514, and the head of the hollow rotating shaft 3514 is cut off an arc block 3518. A sector bulge 3519 and a hollow rotating shaft 3513 are axially held out from the other side of the annular disc 3511, and the head of the hollow rotating shaft 3514 is cut off two arc blocks 3517.

FIG. 9 is a three-dimensional diagram of the second secondary roller 352 of the roller mechanism 35. The second secondary roller 352 is an annular disc 3521 with an inner ring 3523, an annular groove 3522 is set in the inner ring of the annular disc 3521, a sector bulge 3524 and a sector bulge 3528 with an annular convex platform are each axially held out from both sides of the annular disc 3521 and there is a pin hole 35211 for fixing upper ends of the front and rear cords 821 and 822 of the second secondary ladder tape.

FIG. 10 is a three-dimensional diagram of the turning cylinder 354 of the roller mechanism 35. The turning cylinder 354 is a circular cylinder, and on its out ring surface, there is an annular groove 3541 for embedding the first secondary ladder tape 81, an annular groove 3542 for embedding the second secondary ladder tape 82 and an annular groove 3544 for embedding the primary ladder tape 80. A hole 3545 is set on the top of each of the annular grooves 3541 and 3542 and a pin shaft 3546 are mounted on the side, such that the frictional force between the cords of the ladder tapes and the turning cylinder 354 can be reduced after the upper ends of the front and rear cords of the first secondary ladder tape 81 and the second secondary ladder tape 82 go in. A pin hole 3548 is set on the top of the annular groove 3544 and a pin shaft 3547 is mounted therein, and two upper ends of the primary ladder tape 80 are directly set on the pin shaft 3547. Two sector bulges 35410 and 35411 connected with the annular convex platform 35416 around the inner ring 35412 are set on the outer wall of the closed end surface of the turning cylinder 354, the annular convex platform on the inner wall of the closed end surface of the turning cylinder 354 is the extension of the inner wall of the closed end surface and is set with the sector bulge 35417 connected thereto, concave steps 35413, 35414 and 35415 jogged with three sector bulges 3645 on the end of the turning disc 364 are set on the open end of the turning cylinder 354, two pin holes 35421 are drilled on the top of the open end of the turning cylinder 354, so as to insert the pin shaft 3546, and a semicircular notch groove 3549 is set from the open end to the closed end surface on the inner wall on the top of the turning cylinder 354 for use when the primary and secondary ladder tapes are assembled.

Figure 4:
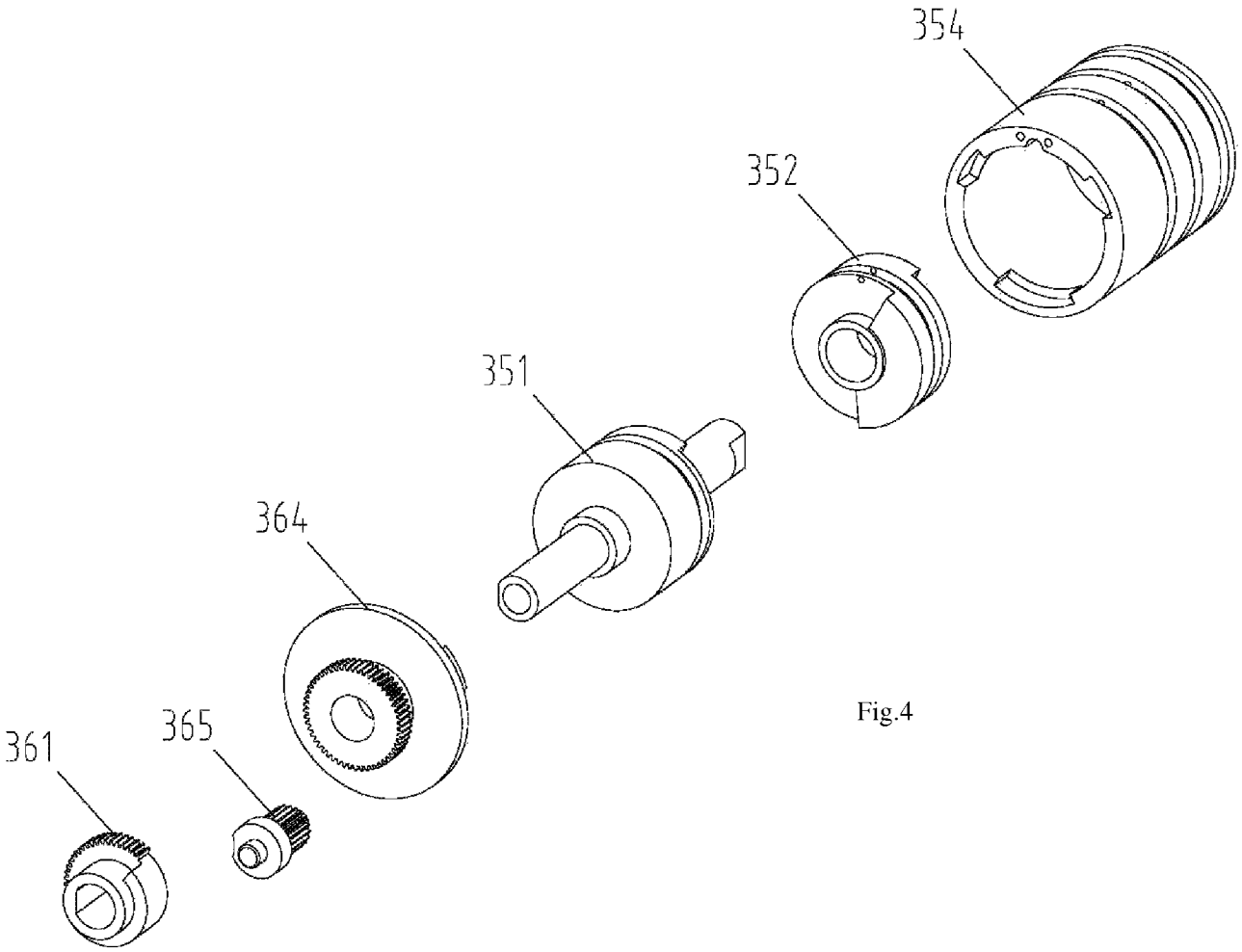
FIG. 4 is a three-dimensional explosive diagram of a roller system 3 (without the base and the top cover) of the pitch-variable combinatorial louver with two secondary louver blades.
Figures 15A, 15B, 15C, 15D, 15E:
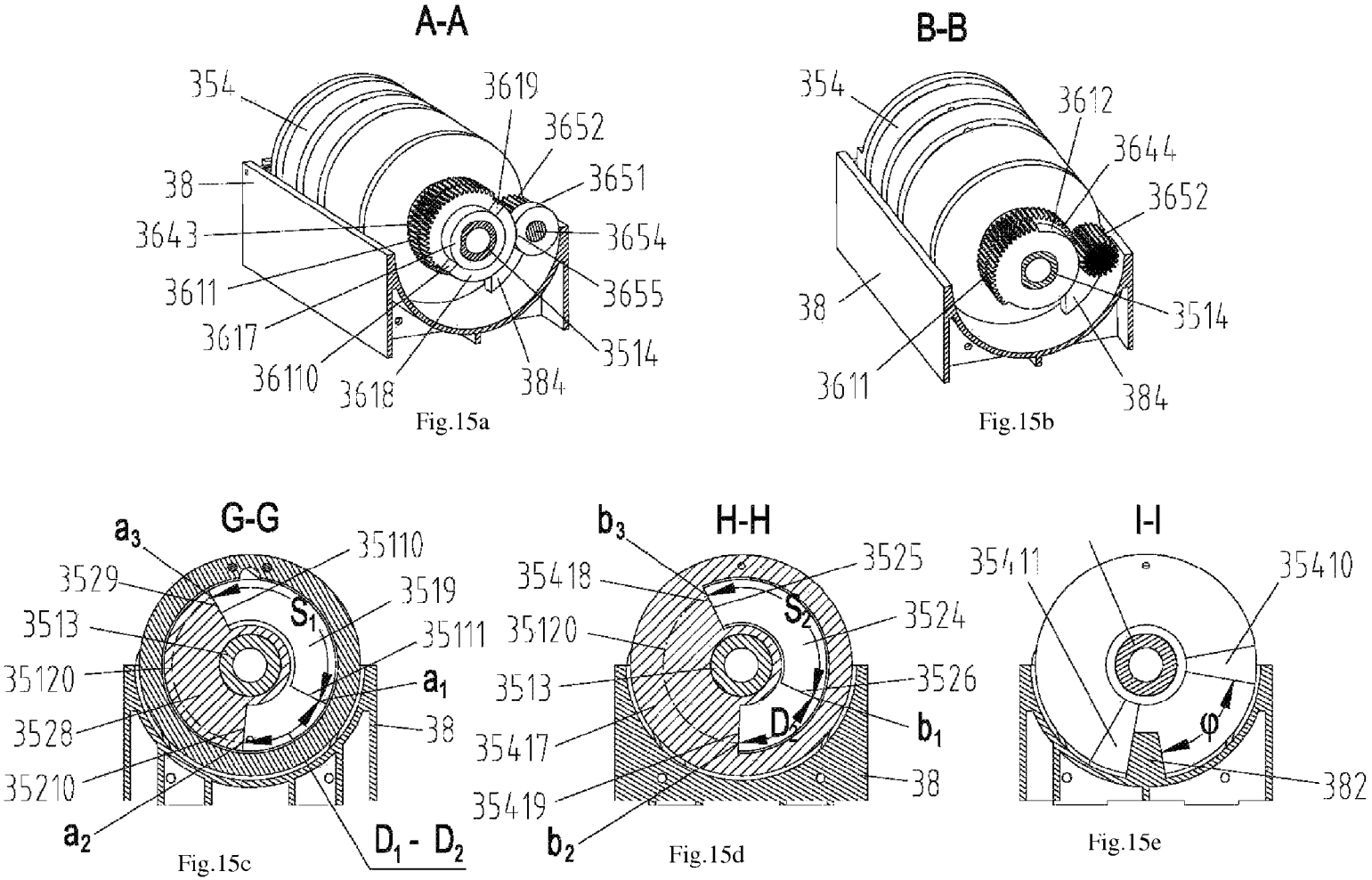
FIG. 15 shows four sectional views of the roller system 3 of the pitch-variable combinatorial louver with two secondary louver blades in the initial state.

FIG. 2 shows the assembly relationship of the roller system of the pitch-variable combinatorial louver with two secondary louver blades, and FIG. 4 shows the assembly order of the roller system 3. The turning disc 364 and the first secondary gear 361 of the turning mechanism 36 are sequentially sheathed on the hollow rotating shaft 3514 on the left end of the first secondary roller 351, such that the head 3518 of the hollow rotating shaft 3514 of the first secondary roller 351 is jogged with the inner ring of the first secondary gear 361, then the second secondary roller 352 and the turning cylinder 354 are sequentially sheathed on the hollow rotating shaft 3513 on the right end of the first secondary roller 351, such that the sector bulge 3519 of the first secondary roller 351 is jogged with the sector bulge 3528 of the second secondary roller 352, and the sector bulge 3524 of the second secondary roller 352 is jogged with the sector bulge 35417 on the inner wall of the closed end surface of the turning cylinder 354. Meanwhile, the sector bulge 3645 of the turning disc 364 is jogged with the grooves 35413, 35414 and 35416 of the turning cylinder 354 as a whole, then this assembly part is placed on the base 38 together with the driven gear 365, such that the hollow rotating shaft 3513 on the right end of the first secondary roller 351 is placed on the right support 381 of the base 38, and the hollow rotating shaft 3514 on the left end of the first secondary roller 351 is placed on the left support 386 of the base 38, at the same time the neutral position between two sector bulges 35410 and 35411 on the closed end surface of the turning cylinder 354 is directed to the bulge 382 of the base 38, such that the turning cylinder 354 can rotate within the preset turning angle $\phi$ of the louver blades. In addition, the shaft 3654 of the driven gear 365 is placed on the support 384 of the base 38 and the teeth 3652 of the driven gear 365 is meshed with the teeth 3643 on the turning disc 364, the locking arc 3655 of the disc 3651 of the driven gear 365 is matched with the outer ring arc surface 3612 of the first secondary gear 361, thus the turning cylinder 354 is locked through the driven gear 365 (as shown in FIG. 15*a*).

Figure 13:
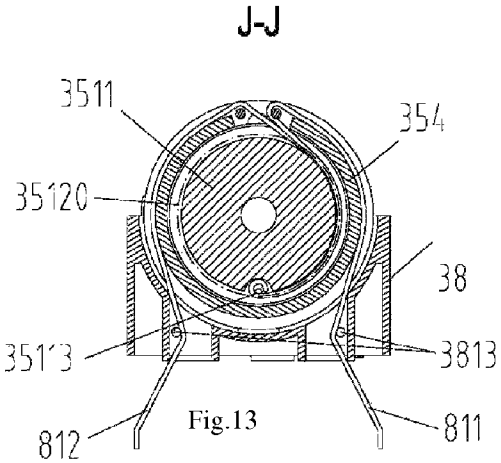
FIG. 13 is a J-J sectional view of the connection type between the roller system 3 of the pitch-variable combinatorial louver with two secondary louver blades and the secondary ladder tapes.
Figure 12:
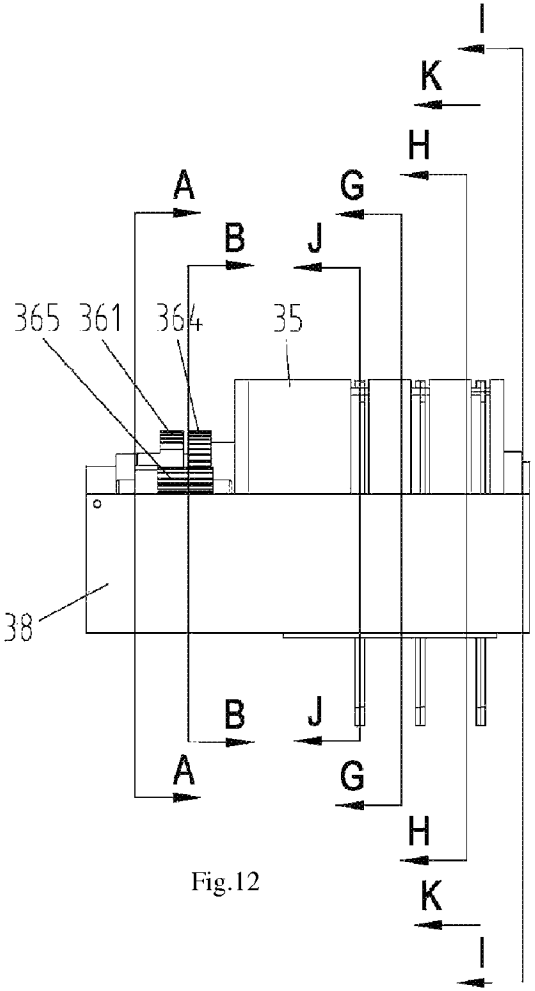
FIG. 12 is the front view and the schematic diagram of profile positions of the roller system 3 of the pitch-variable combinatorial louver with two secondary louver blades.
Figure 11:
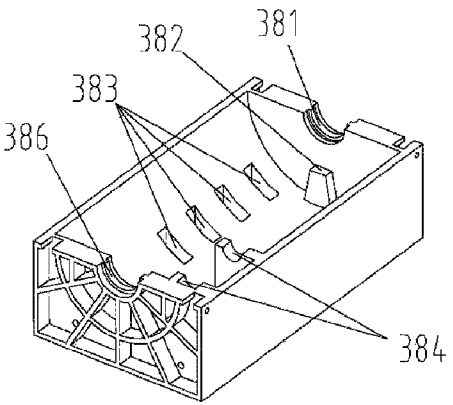
FIG. 11 is a three-dimensional diagram of a base of the roller system 3 of the pitch-variable combinatorial louver with two secondary louver blades.

FIG. 13 is a J-J sectional view of FIG. 12, and this diagram shows the connection type of the front and rear cords 811 and 812 of the first secondary ladder tape 81 with the roller mechanism 35, wherein the upper ends of the front and rear cords 811 and 812 are around the turning cylinder 354 and embedded into the annular groove 3511, then wound on the annular groove 3511 of the first secondary roller 351 after going into the hole 3545 of the turning cylinder 354 and are fixed on the first secondary roller 351 by the pin shaft 35113, and the midline of the cords around which the upper ends of the front and rear cords 811 and 812 of the first secondary ladder tape 81 is wound on the first secondary roller 351 is a circle represented by a dash dot line, which is known as the pitch circle of the first secondary roller 351.

FIG. 14 is a K-K sectional view of FIG. 12, and this diagram shows the connection type of the front and rear cords 801 and 802 of the primary ladder tape 80 with the roller mechanism 35, wherein the upper ends of the front and rear cords 801 and 802 are around and embedded into the annular groove 3544 of the turning cylinder 354, and are fixed on the turning cylinder 354 by the pin shaft 3547 on the top of the annular groove 3544.

Figure 39A:
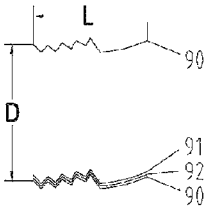
FIG. 39 is a cross-section schematic diagram of a combinatorial louver blade unit of a pitch-variable combinatorial louver with two secondary louver blades in which the secondary louver blades rise and fall relatively, and the primary and secondary louver blades turn over together.
Figure 39B:
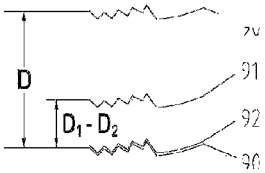
Figure 39C:
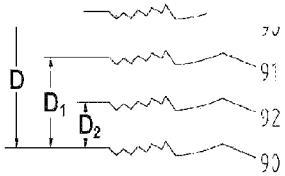
Figure 39D:
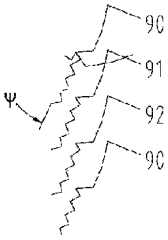

FIG. 15 is various sectional views of the roller system 3 of the pitch-variable combinatorial louver with two secondary louver blades at the initial position (corresponding to the positions of louver blades as shown in FIG. 39*a*). FIG. 16 is various sectional views of the roller system 3 of the pitch-variable combinatorial louver with two secondary louver blades at the binary pitch position (corresponding to the positions of louver blades as shown in FIG. 39*b*). FIG. 17 is various sectional views of the roller system 3 of the pitch-variable combinatorial louver with two secondary louver blades at the quartered pitch position (corresponding to the positions of louver blades as shown in FIG. 39*c*). FIG. 18 is various sectional views of the roller system 3 of the pitch-variable combinatorial louver with two secondary louver blades at the position where louver blades are closed (corresponding to the positions of louver blades as shown in FIG. 39*d*).

When the blade group 9 is at the initial position as shown in FIG. 39*a*, the outer ring arc surface 3612 of the first secondary gear 361 of the turning mechanism 36 of the roller system 3 is matched with the locking arc 3655 of the disc 3651 of the driven gear 365 (as shown in FIG. 15*a*). The outer ring teeth 3611 of the first secondary gear 361 is not meshed with the teeth 3651 of the driven gear 365 (as shown in FIG. 15*b*). The teeth 3651 of the driven gear 365 is meshed with the teeth 3643 of the turning disc 364 all the way, the end wall 35110 of the sector bulge 3519 of the first secondary roller 351 of the roller mechanism 35 is close to the end wall 3529 of the sector bulge 3528 of the second secondary roller 352 (as shown in FIG. 15*c*). The end wall 3525 of the sector bulge 3524 of the second secondary roller 352 is close to the end wall 35418 of the sector bulge 35417 on the inner wall of the closed end surface of the turning cylinder 354 (as shown in FIG. 15*d*). The end wall of the sector bulge 35411 on the closed end surface of the turning cylinder 354 is closely leaned on the end wall of the bulge 382 of the base (as shown in FIG. 15*e*).

Figure 16A:
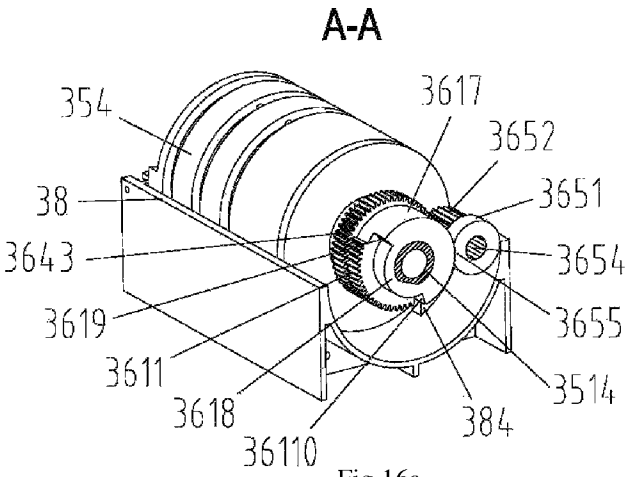
FIG. 16 shows four sectional views of the roller system 3 of the pitch-variable combinatorial louver with two secondary louver blades in the initial state.
Figure 16B:
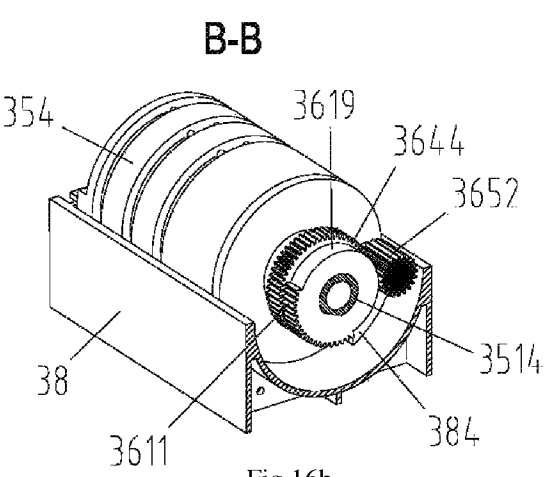
Figure 16C:
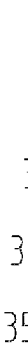
Figure 16D:
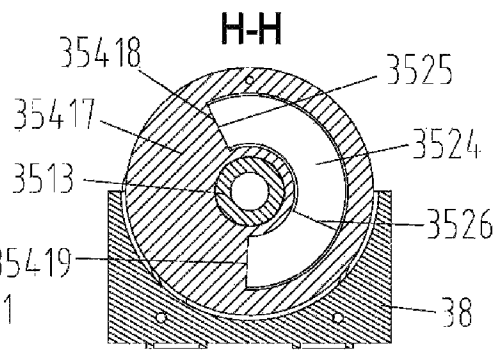
Figure 16E:
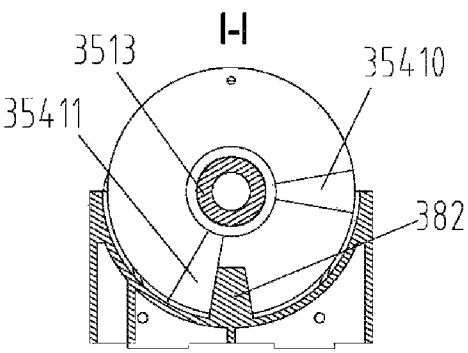

When the hollow rotating shaft 3513 of the first secondary roller 351 is rotated in the clockwise direction as shown in FIG. 15*c*, until the first secondary roller 351 rotates to the position where the end wall 35111 of the sector bulge 3519 is touched with the end wall 35210 of the sector bulge 3528 of the second secondary roller 352 (as shown in FIG. 16*c*), the front and rear cords 811 and 812 of the first secondary ladder tape 81 of the first secondary louver blade 91 are wound by the first secondary roller 351, such that the first secondary louver blade 91 leaves from the position where it is superposed with the second secondary louver blade 92 and horizontally rises an altitude $D_1$–$D_2$ relative to the primary louver blade 90, but the second secondary louver blade 92 is still at the position where it is superposed with the primary louver blade 90 (as shown in FIG. 39*b*). During this rotating process, the first secondary gear 361 jogged with the hollow rotating shaft 3514 of the first secondary roller 351 is rotated in the anti-clockwise direction as shown in FIG. 15*a*, and its outer ring arc surface 3612 is always kept matched with the locking arc 3655 of the disc 3651 of the driven gear 365 (as shown in FIG. 16*a*). Meanwhile, the outer ring teeth 3611 of the first secondary gear 361 are not meshed with the teeth 3652 of the driven gear 365 (as shown in FIG. 16*b*). Thus the turning cylinder 354 is locked and kept still (as shown in FIG. 16*e*). And the second secondary roller 352 is also kept still without exogenic action (as shown in FIG. 16*d*).

Figure 17B:
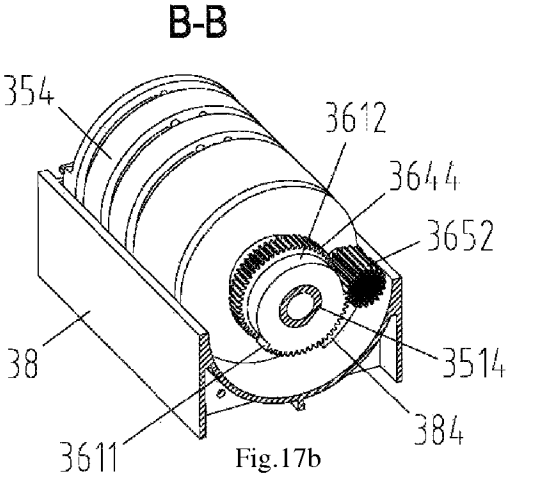
FIG. 17 shows four sectional views of the roller system 3 of the pitch-variable combinatorial louver with two secondary louver blades the initial state.
Figure 17A:
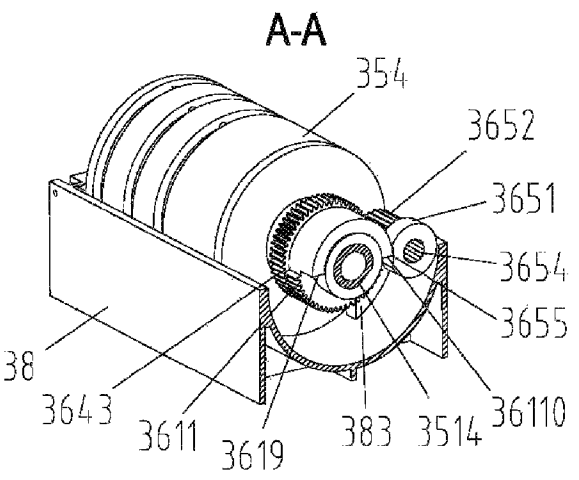
Figure 17E:
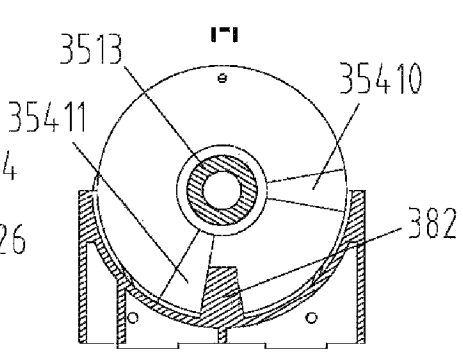
Figure 17D:
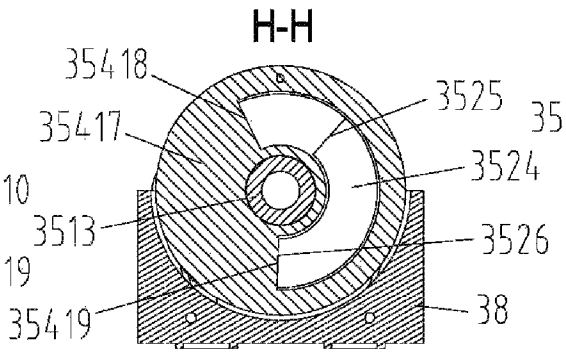
Figure 17C:
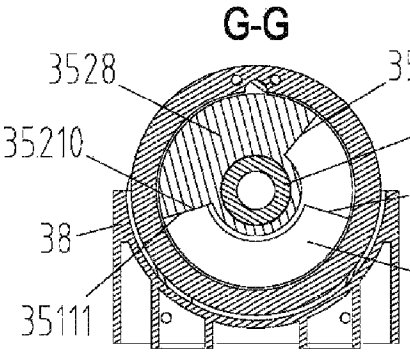

After the end wall 35111 of the sector bulge 3519 of the first secondary roller 351 is touched with the end wall 35210 of the sector bulge 3528 of the second secondary roller 352, the first secondary roller 351 continues to rotate (as shown in FIG. 17*c*). When the end wall 35111 of the sector bulge 3519 of the first secondary roller 351 is pressed against the end wall 35210 of the second secondary roller 352 and pushes the second secondary roller 352 to rotate to the position where the end wall 3526 of its sector bulge 3524 is touched with the end wall 35419 of the sector bulge 35417 on the inner wall of the closed end surface of the turning cylinder 354 (as shown in FIG. 17*d*), the front and rear cords 811 and 812 of the first secondary ladder tape 81 of the first secondary louver blade 91 are wound by the first secondary roller 351, and the front and rear cords 821 and 822 of the second secondary ladder tape 82 of the second secondary louver blade 92 are wound by the second secondary roller 352, such that the first secondary louver blade 91 and the second secondary louver blade 92 horizontally rise an altitude $D_2$ relative to the primary louver blade 90 simultaneously (as shown in FIG. 39*c*). During this rotating process, the first secondary gear 361 is rotated in the anti-clockwise direction as shown in FIG. 16*a*, and its outer ring arc surface 3612 is always kept matched with the locking arc 3655 of the disc 3651 of the driven gear 365 (as shown in FIG. 17*a*). Meanwhile, the outer ring teeth 3611 of the first secondary gear 361 are not meshed with the teeth 3652 of the driven gear 365 (as shown in FIG. 17*b*), thus the driven gear 365 is locked and the turning cylinder 354 is kept still (as shown in FIG. 17*e*).

Figure 18A:
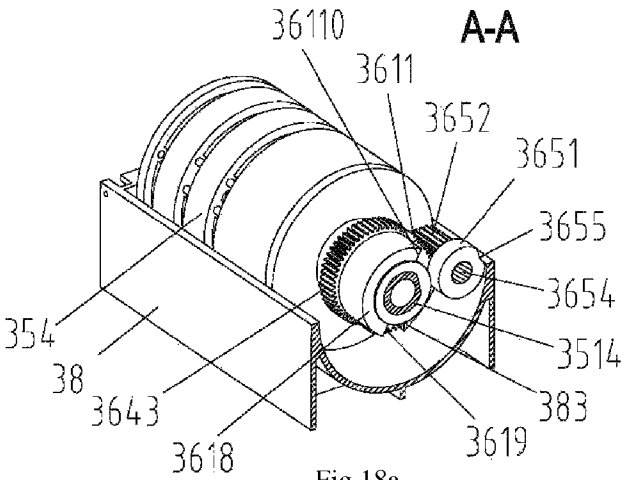
FIG. 18 shows four sectional views of the roller system 3 of the pitch-variable combinatorial louver with two secondary louver blades in the initial state.
Figure 18B:
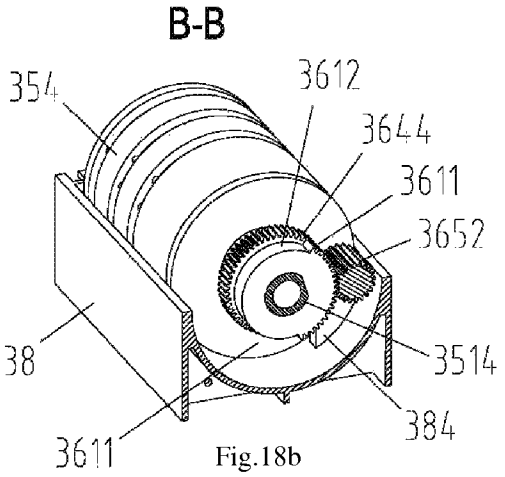
Figure 18C:
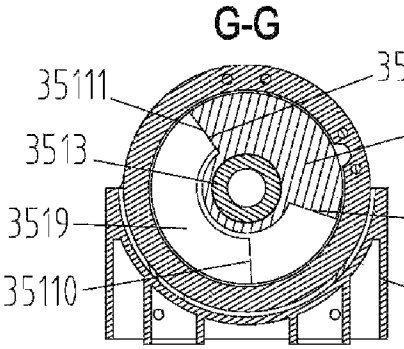
Figure 18D:
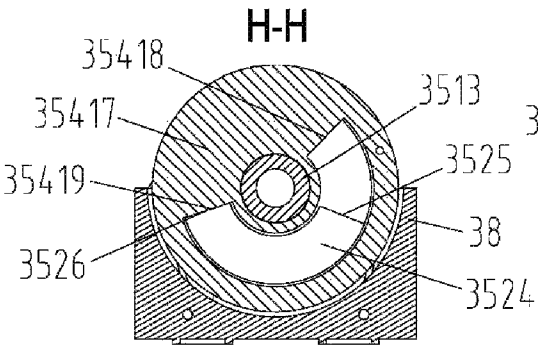
Figure 18E:
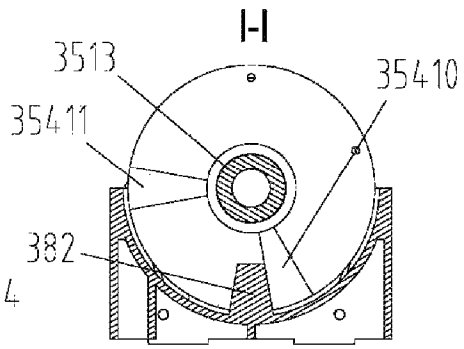

If the hollow rotating shaft 3513 of the first secondary roller 351 continues to be rotated, the side wall 36110 of the outer ring arc surface 3612 of the first secondary gear 361 starts to be detached from the locking arc 3655 of the disc 3651 of the driven gear 365 (as shown in FIG. 18*a*). Meanwhile, the outer ring teeth of the first secondary gear 361 start to be meshed with the teeth 3652 of the driven gear 365 (as shown in FIG. 18*b*). And the teeth 3652 of the driven gear 365 is meshed with the teeth 3643 of the turning disc 364, so as to drive the turning cylinder 354 to rotate, and during this rotating process, the end wall 35111 of the sector bulge 3519 of the first secondary roller 351 is pressed against the end wall 35210 of the sector bulge 3528 of the second secondary roller 352 and pushes the second secondary roller 352 to rotate (as shown in FIG. 18*c*), but the second secondary roller 352 rotates synchronously with the turning cylinder 354 while the end wall 3526 of its sector bulge 3524 is close to the end wall 35418 of the sector bulge 35417 on the inner wall of the closed end surface of the turning cylinder 354 (as shown in FIG. 18*d*), and the turning cylinder 354 rotates until the sector bulge 35410 on its closed end surface is close to the bulge 382 of the base 38 (as shown in FIG. 18*e*). The front and rear cords 811 and 812 of the first secondary ladder tape 81 of the first secondary louver blade 91 are wound by the first secondary roller 351, the front and rear cords 821 and 822 of the second secondary ladder tape 82 of the second secondary louver blade 92 are wound by the second secondary roller 352, and the front and rear cords 801 and 802 of the primary ladder tape 80 of the primary louver blade 90 are wound by the turning cylinder 354, such that the primary and secondary louver blades 9 turn $\phi$ simultaneously (as shown in FIG. 39*d*).

When the first secondary louver blade 91 and the second secondary louver blade 92 complete relative rising and turn to the closed position together with the primary louver blade 90 along with the turning cylinder 354, the hollow rotating shaft 3513 of the first secondary roller 351 is rotated reversely, then the primary and secondary louver blades 9 are withdrawn in the original order, namely, first the primary and secondary louver blades 9 simultaneously turn to a horizontal position as shown in FIG. 39*c*. While the primary and secondary louver blades 9 turn to the horizontal position, the first secondary roller 351 does not apply acting force on the second secondary roller 352 no longer, the first secondary gear 361 jogged with the hollow rotating shaft 3514 of the first secondary roller 351 rotates in the clockwise direction as shown in FIG. 18*a*, the outer ring arc surface 3612 of the first secondary gear 361 is not touched with the locking arc 3655 of the disc 3651 of the driven gear 365, but the outer ring teeth 3611 of the first secondary gear 361 are meshed with the teeth 3652 of the driven gear 365, and the teeth 3652 of the driven gear 365 is meshed with the teeth 3643 of the turning disc 364, so as to drive the turning cylinder 354 to rotate in the clockwise direction as shown in FIG. 18*a*, and the end wall 35418 of the sector bulge 35417 on the inner wall of the closed end surface of the turning cylinder 354 is pressed against the end wall 3525 of the sector bulge 3524 of the second secondary roller 352, to allow it to reversely rotate together until the primary and secondary louver blades 9 turn to the horizontal position. When the primary and secondary louver blades 9 turn to the horizontal position, the outer ring arc surface 3612 of the first secondary gear 361 starts to be matched with the locking arc 3655 of the disc 3651 of the driven gear 365, meanwhile the outer ring teeth 3611 of the first secondary gear 361 starts to be detached from the teeth 3652 of the driven gear 365 and the turning cylinder 354 is locked.

The hollow rotating shaft 3513 of the first secondary roller 351 continues to rotate reversely, the first secondary roller 351 has no reverse pushing effect on the second secondary roller 352 and the second secondary roller 352 is rotated reversely under the gravity of the second secondary base rail 102 and the second secondary louver blade 92 delivered by the second secondary ladder tape 82, but the end wall 35210 of the sector bulge 3528 of the second secondary roller 352 is obstructed by the end wall 35111 of the sector bulge 3519 of the first secondary roller 351 all the way while the second secondary louver blade 92 and the second secondary base rail 102 fall down, such that the second secondary roller 352 rotates all the way along with the first secondary roller 351 reversely, until the second secondary louver blade 92 is superposed on the primary louver blade 90. Up to this point, the first secondary louver blade 91 and the second secondary louver blade 92 have fell an altitude $D_2$ relative to the primary louver blade 90 (as shown in FIG. 39*b*), meanwhile the end wall 3526 of the sector bulge 3524 of the second secondary roller 352 is propped against the end wall 35419 of the sector bulge 35417 on the inner wall of the closed end surface of the turning cylinder 354 without the probability of turning back.

The hollow rotating shaft 3513 of the first secondary roller 351 continues to rotate reversely until the first secondary louver blade 91 fall to the position where it is superposed with the second secondary louver blade 92 as shown in FIG. 39*a*, the first secondary roller 351 turns back to the initial position. At this point, the end wall 35110 of the sector bulge 3519 of the first secondary roller 351 is propped by the end wall 3529 of the sector bulge 3528 of the second secondary roller 352, the end wall 3525 of the sector bulge 3524 of the second secondary roller 352 is propped by the end wall 35418 of the sector bulge 35417 on the inner wall of the closed end surface of the turning cylinder 354, and the sector bulge 35411 on the closed end surface of the turning cylinder 354 is propped by the bulge 382 of the base 38, such that the first secondary roller 351 can not continue to rotate reversely (as shown in FIG. 15).

The internal relationship of the roller mechanism 35 is dependent on relative lifting heights $D_1$ and $D_2$ and turning closed angle $\phi$ of the primary and secondary louver blades 9. FIG. 15*c* is the G-G sectional view of FIG. 12, in which the circle with dash dot line is the pitch circle 35120 where the first secondary ladder tape 82 is embedded into the annular groove 3512 of the first secondary roller 351, the sector bulge 3518 of the first secondary roller 351 and the sector bulge 3528 of the second secondary roller 352 are jogged with each other, and the end wall 35110 of the sector bulge 3518 of the first secondary roller 351 and the end wall 3529 of the sector bulge 3528 of the second secondary roller 352 are kept together at the initial position. First, a point $a_1$ is randomly selected on the pitch circle 35120 of the annular groove 3512, then the end wall 35110 of the sector bulge 3518 of the first secondary roller 351 can be determined by drawing a radial line from this point, a point $a_2$ is found from the point $a_1$ along the pitch circle 35120 of the annular groove 3512 in the clockwise direction, to make the arc length of the pitch diameter of the annular groove 3512 between $a_1$ and $a_2$ equal to $D_1-D_2$ between the first secondary louver blade 91 and the second secondary louver blade 92 (as shown in FIG. 39*b*). Thus a neutral position between the sector bulge 3518 of the first secondary roller 351 and the sector bulge 3528 of the second secondary roller 352 is determined, and a point $a_3$ is found from the point $a_1$ along the pitch circle 35120 of the annular groove 3512 in the anti-clockwise direction, the arc length of the pitch diameter of the annular groove 3512 between $a_1$ and $a_3$ is $S_1$, $S_1$ could be determined in the consideration of respective strength of the sector bulge 3518 of the first secondary roller 351 and the sector bulge 3528 of the second secondary roller 352, and if $S_1$ is determined, the circumferential sizes of the sector bulge 3518 of the first secondary roller 351 and the sector bulge 3528 of the second secondary roller 352 are determined.

FIG. 15*d* is the H-H sectional view of FIG. 12. The sector bulge 3524 of the second secondary roller 352 is jogged with the sector bulge 35417 on the inner wall of the closed end surface of the turning cylinder 354, the end wall 3526 of the sector bulge 3524 of the second secondary roller 352 and the end wall 35419 of the sector bulge 35417 on the inner wall of the closed end surface of the turning cylinder 354 are kept together at the initial position. First, a point $b_1$ is randomly selected on the pitch circle 35120 of the annular groove 3512, then the end wall 3525 of the sector bulge 3524 of the second secondary roller 352 can be determined by drawing a radial line from this point, a point $b_2$ is found from the point $b_1$ along the pitch circle 35120 of the annular groove 3512 in the clockwise direction, to make the arc length of the pitch diameter of the annular groove 3512 between $b_1$ and $b_2$ equal to $D_1$ between the second secondary louver blade 92 and the primary secondary louver blade 90 (as shown in FIG. 39*c*). Thus a neutral position between the sector bulge 3524 of the second secondary roller 352 and the sector bulge 35417 on the inner wall of the closed end surface of the turning cylinder 354 is determined, and a point $b_3$ is found from the point $b_1$ along the pitch circle 35120 of the annular groove 3512 in the anti-clockwise direction, the arc length of the pitch diameter of the annular groove 3512 between $b_1$ and $b_3$ is $S_2$, $S_2$ could be determined in the consideration of respective strength of the sector bulge 3524 of the second secondary roller 352 and the sector bulge 35417 on the inner wall of the closed end surface of the turning cylinder 354, and if $S_2$ is determined, the circumferential sizes of the sector bulge 3524 of the second secondary roller 352 and the sector bulge 35417 on the inner wall of the closed end surface of the turning cylinder 354 are determined.

FIG. 15*e* is the I-I sectional view of FIG. 12. At the initial position, one side of the sector bulge 35411 on the closed end surface of the turning cylinder 354 is close to one side of the convex platform 382 of the base 38, and the angle between one side of the sector bulge 35410 on the closed end surface of the turning cylinder 354 and one side of the bulge 382 of the base 38 is equal to the turning closed angle $\phi$ of the primary and secondary louver blades.

The relationship between the first secondary gear 361 and the driven gear 365 of the turning mechanism 36 is still dependent on the relative lifting heights $D_1$ and $D_2$ and turning closed angle $\phi$ of the primary and secondary louver blades.

Example 2

Turning Cylinder with Three Rollers Mounted therein, a Structure with Three Secondary Louver Blades (Dual Binary Pitch)

A movement cycle of relative lifting and turning of combinatorial louver blades of the pitch-variable combinatorial louver with three secondary louver blades (dual binary pitch) is as follows: (1) the primary louver blade 90 is spread over the louver at an equal space, and the secondary louver blades 91, 92 and 93 are sequentially superposed on the primary louver blade 90 (corresponding to FIG. 40*a*); (2) the first secondary louver blade 91 and the second secondary louver blade 92 rises to the position $D_2$ relative to the primary louver blade 90 (corresponding to FIG. 40*b*); (3) the second secondary louver blade 92 is detached from the first secondary louver blade 91 and is located at the position $D_2$, the first secondary louver blade 91 and the third secondary louver blade 93 rise a distance $D_3$ relative to the primary louver blade 90, at this point the first secondary louver blade 91 is located at the position $D_1$, and the third secondary louver blade 93 is located at the position $D_3$ (corresponding to FIG. 40*c*); (4) the primary and secondary louver blades 90, 91, 92 and 93 simultaneously rotate $\phi$ from a horizontal position until the louver is closed (corresponding to FIG. 40*d*); (5) the primary and secondary louver blades 90, 91, 92 and 93 simultaneously turn back $\phi$ to the initial horizontal position (corresponding to FIG. 40*c*); (6) the first secondary louver blade 91 and the third secondary louver blade 93 fall a distance $D_3$ relative to the primary louver blade 90, until the third secondary louver blade 93 is superposed on the primary louver blade 90 (corresponding to FIG. 40*b*); and (7) the first secondary louver blade 91 and the second secondary louver blade 92 fall a distance $D_2$ relative to the primary louver blade 90, until the second secondary louver blade 92 is superposed on the third secondary louver blade 93, and the first secondary louver blade 91 is superposed on the second secondary louver blade 92 (corresponding to FIG. 40*a*), here D/L is set to be 1.6, $D_1=D_2+D_3$, $D_2=D/2$, and $D_3=D/4$.

Figures 19, 20:
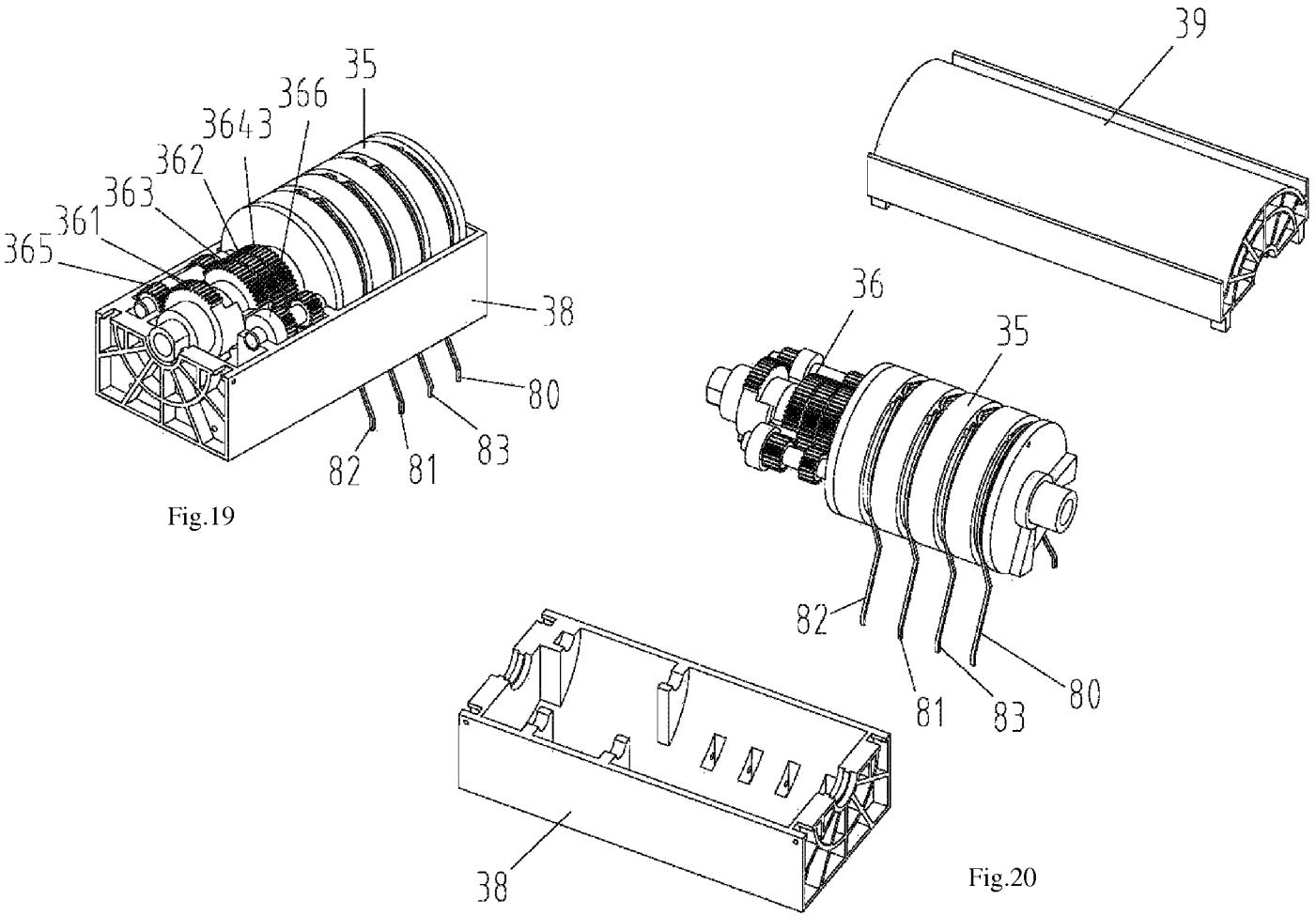
FIG. 19 is a three-dimensional diagram of the roller system 3 (without the top cover) of the pitch-variable combinatorial louver with three secondary louver blades (dual binary pitch).
FIG. 20 is a three-dimensional explosive diagram of the roller system 3 of the pitch-variable combinatorial louver with three secondary louver blades (dual binary pitch).
Figure 21:
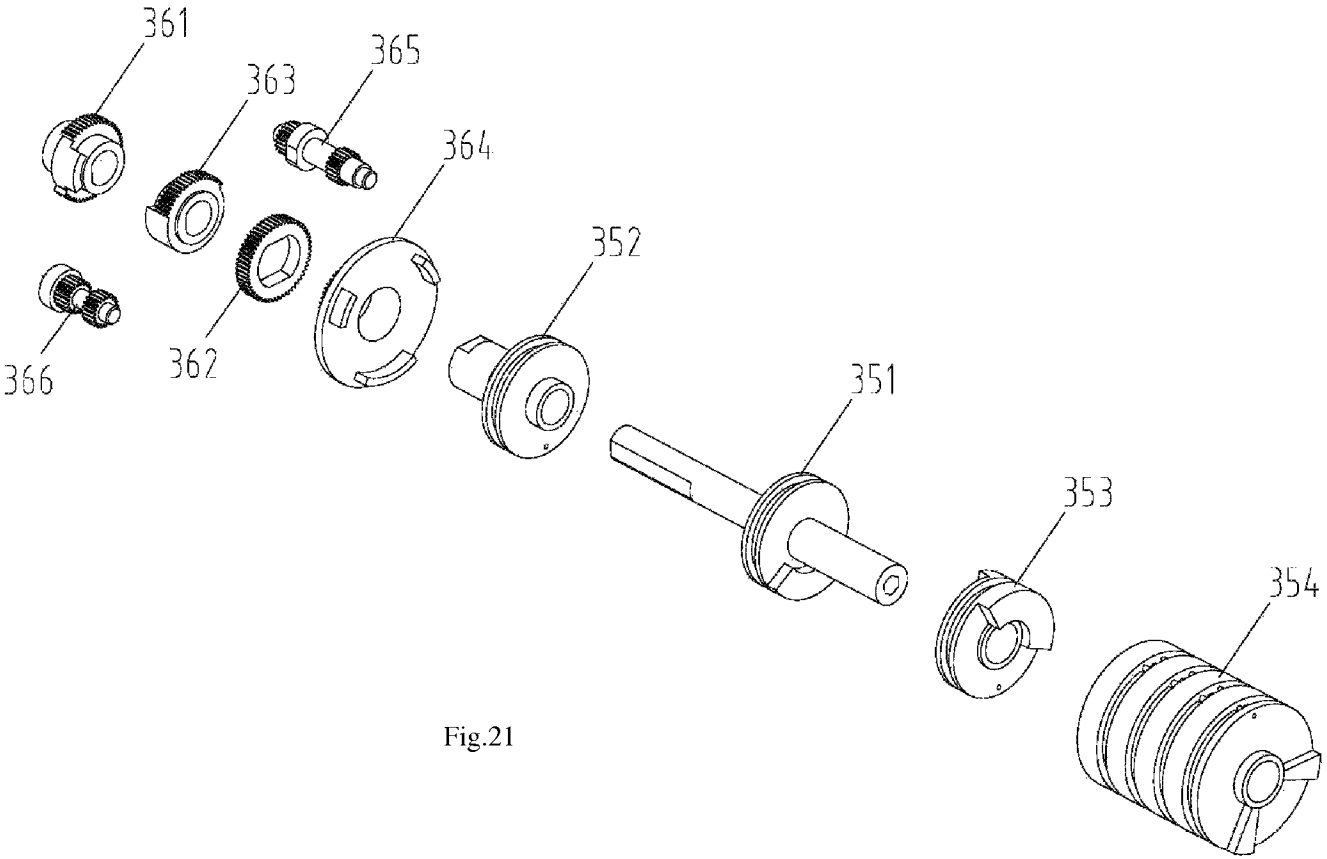
FIG. 21 is a three-dimensional explosive diagram of the roller system 3 (without the base and the tope cover) of the pitch-variable combinatorial louver with three secondary louver blades (dual binary pitch).

According to FIGS. 19, 20 and 21, the roller system 3 for the pitch-variable combinatorial louver with three secondary louver blades (dual binary pitch) comprises the roller mechanism 35 and the intermittent gear turning mechanism 36. The roller mechanism 35 comprises a first secondary roller 351, a second secondary roller 352, a third secondary roller 353 and a turning cylinder 354, and the first secondary roller 351, the second secondary roller 352 and the third secondary roller 353 are mounted within the turning cylinder 354. The intermittent gear turning mechanism 36 comprises a first secondary gear 361, a second secondary gear 362, a third secondary gear 363, a turning disc 364, a second secondary driven gear 365 and a third secondary driven gear 366.

Figure 27A:
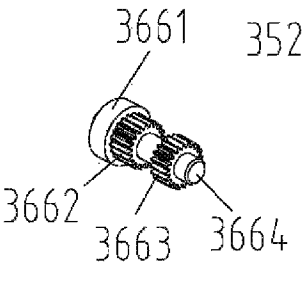
FIG. 27 is a three-dimensional diagram of a third secondary driven gear of the roller system 3 of the pitch-variable combinatorial louver with three secondary louver blades (dual binary pitch).
Figure 27B:
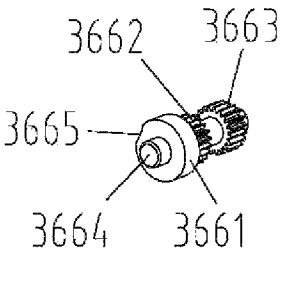
Figure 26A:
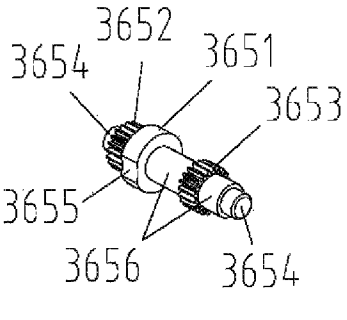
FIG. 26 is a three-dimensional diagram of a second secondary driven gear of the roller system 3 of the pitch-variable combinatorial louver with three secondary louver blades (dual binary pitch).
Figure 26B:
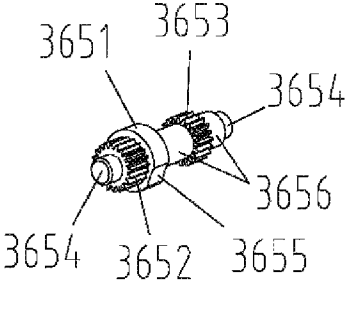

FIG. 22 is a three-dimensional diagram of the first secondary gear 361 of the intermittent gear turning mechanism 36, and FIG. 23 is a three-dimensional diagram of the third secondary gear 363 of the intermittent gear turning mechanism 36. The fundamental principles of the structure of the intermittent gear turning mechanism 36 in this example are the same as Example 1, FIG. 24 is a three-dimensional diagram of the second secondary gear 362 of the intermittent gear turning mechanism 36, and the second secondary gear 362 is a common gear of which the shape is an inner ring 3624 same as the end of the hollow rotating shaft 3524 of the second secondary roller 352. FIG. 25 is a three-dimensional diagram of the turning disc 364 of the intermittent gear turning mechanism 36, the turning disc 364 is identical to that in Example 1, and FIG. 26 is a three-dimensional diagram of the second secondary driven gear 365 of the intermittent gear turning mechanism 36. FIG. 27 is a three-dimensional diagram of the third secondary driven gear 366 of the intermittent gear turning mechanism 36, the second secondary driven gear 365 and the third secondary driven gear 366 are the modified versions of the driven gear 365 in Example 1, the second secondary driven gear 365 consists of a rotating shaft 3656 which sequentially passes through the teeth 3652, the disc 3651 with the locking arc 3655 and the teeth 3653, the second secondary driven gear 365 has its diameters of both ends reduced for meeting requirements of the support 384 of the base 38 and becomes 3654, and the third secondary driven gear 366 consists of a rotating shaft 3664 which sequentially passes through the disc 3661 with the locking arc 3665 and teeth 3662 and 3663 at a certain interval.

Figure 28A:
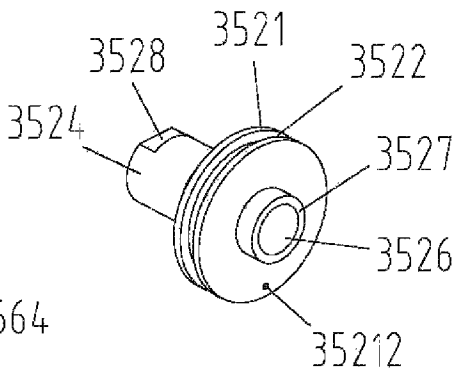
FIG. 28 is a three-dimensional diagram of a second secondary roller of the roller system 3 of the pitch-variable combinatorial louver with three secondary louver blades (dual binary pitch).
Figure 28B:
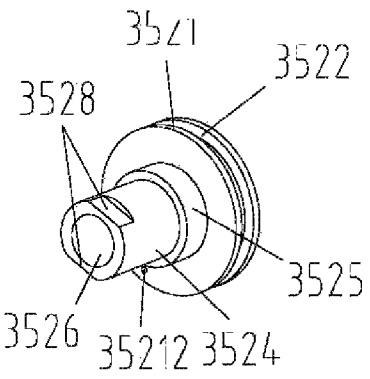

FIG. 28 is a three-dimensional diagram of the second secondary roller 352 of the roller mechanism 35, the second secondary roller 352 is an annular disc 3521 with an inner ring 3526, an annular convex platform 3527 for axially locating is axially held out from the right of the annular disc 3521, a hollow rotating shaft 3524 with an axial step 3525 is axially held out from the left of the annular disc 3521, one end of the hollow rotating shaft 3514 is cut off two arc blocks 3528 and acts as the shaft key, and a pin hole 35212 is set at the side of the annular disc 3521.

Figure 29A:
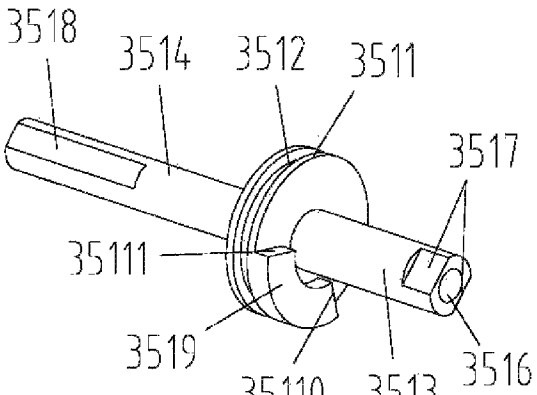
FIG. 29 is a three-dimensional diagram of a first secondary roller of the roller system 3 of the pitch-variable combinatorial louver with three secondary louver blades (dual binary pitch).
Figure 29B:
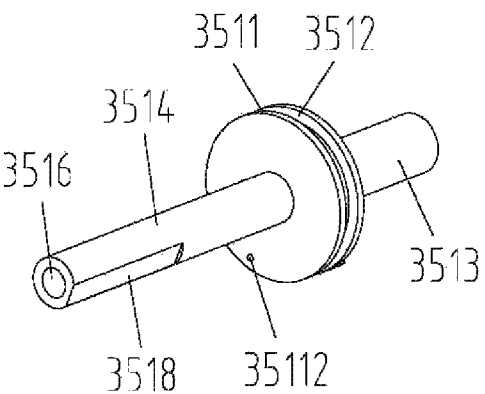

FIG. 29 is a three-dimensional diagram of the first secondary roller 351 of the roller mechanism 35, the first secondary roller 351 is an annular disc 3511, an annular groove 3512 is set in the outer ring of the annular disc 3511, a hollow rotating shaft 3514 is axially held out from one side of the annular disc 3511, the outer ring on one end of the hollow rotating shaft 3514 is cut off a block 3518 and acts as the shaft key, a hollow rotating shaft 3513 and a sector bulge 3519 with two end walls 35110 and 35111 are axially held out from the other side of the annular disc 3511, the outer ring on one end of the hollow rotating shaft 3513 is cut off two blocks 3517 and acts as the shaft key, and a pin hole 35118 is also set at the side of the annular disc 3511, for fixing upper ends of the front and rear cords 811 and 812 of the first secondary ladder tape.

FIG. 30 is a three-dimensional diagram of the third secondary roller 353 of the roller mechanism 35, the third secondary roller 353 is an annular disc 3531 with an inner ring 3533 and an annular groove 3532 set in the outer ring, a sector bulge 3534 which is connected with the annular convex platform 3533 and has two end walls 3535 and 3536 and a sector bulge 3538 which is connected with the annular convex platform 3537 and has two end walls 3539 and 35310 are each axially held out from two sides of the annular disc 3531 and a pin hole 35311 is set, for fixing upper ends of the front and rear cords 831 and 832 of the third secondary ladder tape.

FIG. 31 is a three-dimensional diagram of the turning cylinder 354 of the roller mechanism 35, the turning cylinder 354 is a circular cylinder, and on its out ring surface, there are annular grooves 3541, 3542 and 3543 for embedding the secondary ladder tapes 81, 82 and 83 and an annular groove 3544 for embedding the primary ladder tape 80, sequentially. A hole 3545 is set on the top of each of the annular grooves 3541, 3542 and 3543 and a pin shaft 3546 is mounted on the side, such that the frictional force between the cords of the ladder tapes and the turning cylinder 354 can be reduced after the upper ends of the front and rear cords of the secondary ladder tapes 81 and 82 go in. A pin hole 3548 is set on the top of the annular groove 3544 and a pin shaft 3547 is mounted therein, and two upper ends of the primary ladder tape 80 are directly set on the pin shaft 3547, and two sector bulges 35410 and 35411 connected with the annular convex platform 35416 around the inner ring 35412 are set on the outer wall of the closed end surface of the turning cylinder 354. The annular convex platform on the inner wall of the closed end surface of the turning cylinder 354 is the extension of the annular convex platform 35416 on the outer wall of the closed end surface and is set with the sector bulge 35417 connected thereto, concave steps 35413, 35414 and 35415 jogged with three sector bulges 3645 on the end of the turning disc 364 are set on the open end of the turning cylinder 354, two pin holes 35421 are drilled on the top of the open end of the turning cylinder 354, so as to insert the pin shaft 3546, and a semicircular notch groove 3549 is set from the open end to the closed end surface on the inner wall on the top of the turning cylinder 354 for use when the primary and secondary ladder tapes are assembled.

FIGS. 19 and 20 show the assembly situation of the roller system 3 of the pitch-variable combinatorial louver with three secondary louver blades (dual binary pitch), and FIG. 21 shows the assembly order of the roller system 3. The turning disc 364 and the second secondary gear 362 of the turning mechanism 36 are sequentially sheathed on the hollow rotating shaft 3524 on the left end of the second secondary roller 352, such that the head 3528 of the hollow rotating shaft 3524 of the second secondary roller 352 is jogged with the inner ring 3624 of the second secondary gear 362 as a whole. Then the second secondary roller 352, the third secondary gear 363 and the first secondary gear 361 are sequentially sheathed on the hollow rotating shaft 3514 on the left end of the first secondary roller 351, such that the inner ring 3614 of the first secondary gear 361 and the inner ring 3634 of the third secondary gear 363 are jogged with the end 3518 of the hollow rotating shaft 3514 on the left end of the first secondary roller 351 as a whole, next the third secondary roller 353 and the turning cylinder 354 are sequentially sheathed on the hollow rotating shaft 3513 on the right end of the first secondary roller 351, such that the sector bulge 3519 of the first secondary roller 351 is jogged with the sector bulge 3538 of the third secondary roller 353, the sector bulge 3534 of the third secondary roller 353 is jogged with the sector bulge 35417 on the inner wall of the closed end surface of the turning cylinder 354, and meanwhile, the sector bulge 3645 of the turning disc 364 is jogged with the grooves 35413, 35414 and 35416 of the turning cylinder 354 as a whole. Then this assembly part is placed on the base 38 together with the third secondary driven gear 365 and the second secondary driven gear 366, such that the hollow rotating shaft 3513 on the right end of the first secondary roller 351 is placed on the right support 381 of the base 38, and the hollow rotating shaft 3514 on the left end of the first secondary roller 351 is placed on the left support 386 of the base 38. At the same time the neutral position between two sector bulges 35410 and 35411 on the closed end surface of the turning cylinder 354 is directed to the bulge 382 of the base 38, such that the turning cylinder 354 can rotate within the preset turning angle $\phi$ of the louver blades. In addition, both ends 3654 of the shaft 3656 of the second secondary driven gear 365 are placed on the support 385 of the base 38 and the teeth 3652 of the second secondary driven gear 365 is meshed with the outer ring teeth 3611 of the first secondary gear 361, and the teeth 3653 of the second secondary driven gear 365 is meshed with the outer ring teeth 3621 of the second secondary gear 362. Both ends of the shaft 3664 of the third secondary driven gear 366 are placed on the support 384 of the base 38 and the locking arc 3665 on the disc 3661 of the third secondary driven gear 366 is matched with the outer ring arc surface 3632 of the third secondary gear 363, and the teeth 3663 of the third secondary driven gear 366 is meshed with the teeth 3643 of the turning disc 364, thus the turning cylinder 354 is locked through the third secondary driven gear 366 (as shown in FIG. 34).

The internal relationship of the roller system 3 for the pitch-variable combinatorial louver with three secondary louver blades (dual binary pitch) is dependent on relative lifting heights $D_2$ and $D_3$ and turning closed angle $\phi$ of the primary and secondary louver blades 9, its design principles are consistent with Example 1, and see FIGS. 39 and 40 for relevant dimensions of the movement relationship between the roller system and the louver blades.

Figure 40A:
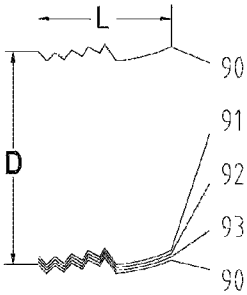
FIG. 40 is a cross-section schematic diagram of a combinatorial louver blade unit of a pitch-variable combinatorial louver with three secondary louver blades (dual binary pitch) in which the secondary louver blades rise and fall relatively, and the primary and secondary louver blades turn over and close together.
Figure 40B:
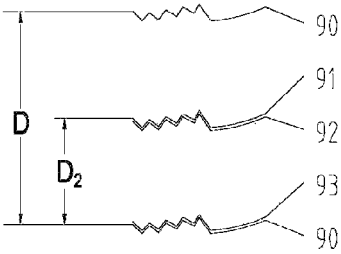
Figure 40C:
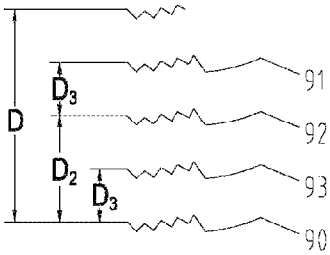
Figure 40D:
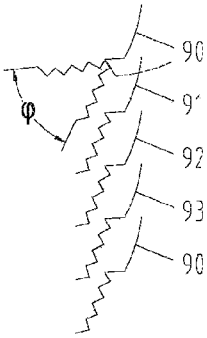

FIG. 34 is various sectional views of the roller system 3 of the pitch-variable combinatorial louver with three secondary louver blades at the initial position (corresponding to the positions of louver blades as shown in FIG. 40*a*). FIG. 35 is various sectional views of the roller system 3 of the pitch-variable combinatorial louver with three secondary louver blades at the binary pitch position (corresponding to the positions of louver blades as shown in FIG. 40*b*). FIG. 36 is various sectional views of the roller system 3 of the pitch-variable combinatorial louver with three secondary louver blades at the quartered pitch position (corresponding to the positions of louver blades as shown in FIG. 40*c*). FIG. 37 is various sectional views of the roller system 3 of the pitch-variable combinatorial louver with three secondary louver blades at the position where louver blades are closed (corresponding to the positions of louver blades as shown in FIG. 40*d*).

Figure 34I:
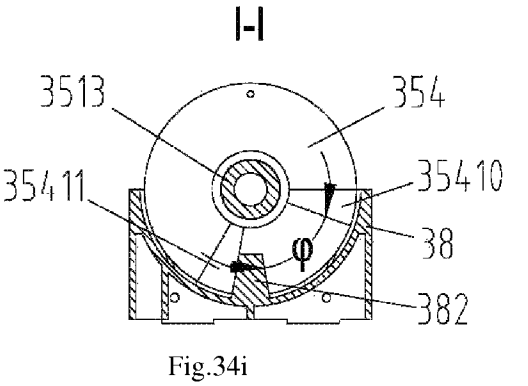
FIG. 34 shows nine sectional views of the roller system 3 of the pitch-variable combinatorial louver with three secondary louver blades (dual binary pitch) in the initial state.
Figure 34H:
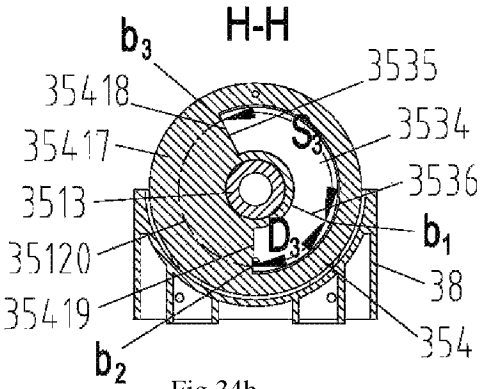
Figure 34G:
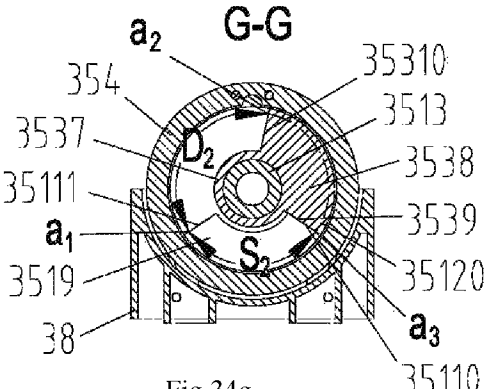

When the blade group 9 is at the initial position as shown in FIG. 40*a*, the outer ring teeth 3611 of the first secondary gear 361 of the turning mechanism 36 of the roller system 3 are meshed with the teeth 3652 of the second secondary driven gear 365 (as shown in FIG. 34*a*); the outer ring arc surface 3612 of the first secondary gear 361 is not matched with the locking arc 3655 of the disc 3651 of the second secondary driven gear 365 (as shown in FIG. 34*b*); the teeth 3652 of the second secondary driven gear 365 is meshed with the second secondary gear 362 all the way (as shown in FIG. 34*e*); the outer ring arc surface 3632 of the third secondary gear 363 is matched with the locking arc 3665 of the disc 3661 of the third secondary driven gear 366 (as shown in FIG. 34*c*); the outer ring teeth 3631 of the third secondary gear 363 are not meshed with the teeth 3662 of the third secondary driven gear 366 (as shown in FIG. 34*d*); the teeth 3663 of the third secondary driven gear 366 is meshed with the teeth 3643 of the turning disc 364 all the way (as shown in FIG. 34*f*); the end wall 35110 of the sector bulge 3519 of the first secondary roller 351 of the roller mechanism 35 is close to the end wall 3539 of the sector bulge 3538 of the third secondary roller 353 (as shown in FIG. 34*g*); the end wall 3535 of the sector bulge 3534 of the third secondary roller 353 is close to the end wall 35418 of the sector bulge 35417 on the inner wall of the closed end surface of the turning cylinder 354 (as shown in FIG. 34*h*); and the end wall of the sector bulge 35411 on the closed end surface of the turning cylinder 354 is closely leaned on the end wall of the bulge 382 of the base (as shown in FIG. 34*i*).

Figure 35C:
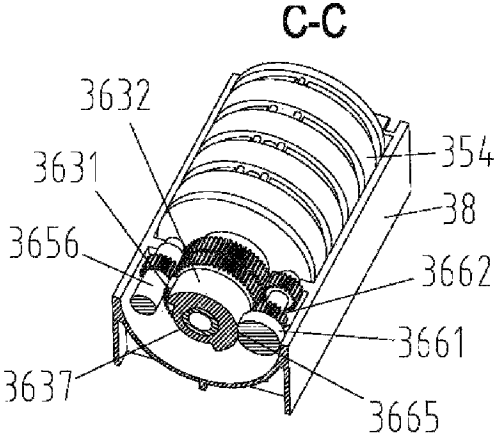
FIG. 35 shows nine sectional views of the roller system 3 of the pitch-variable combinatorial louver with three secondary louver blades (dual binary pitch) in the binary pitch state.
Figure 35B:
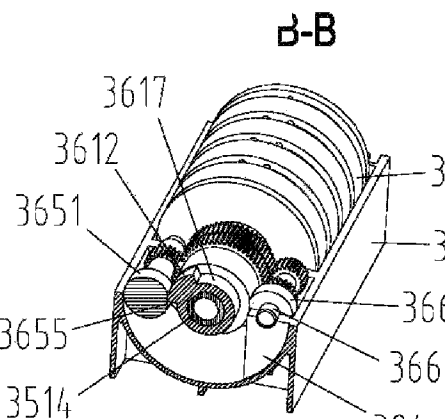
Figure 35A:
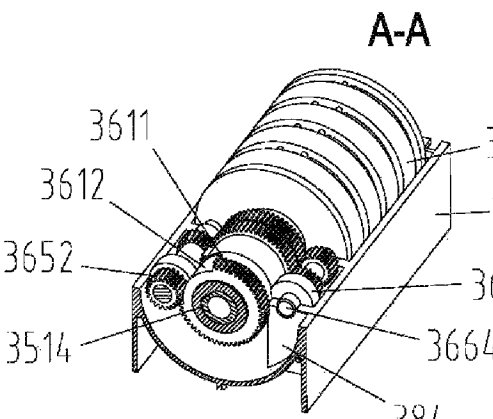
Figure 35D:
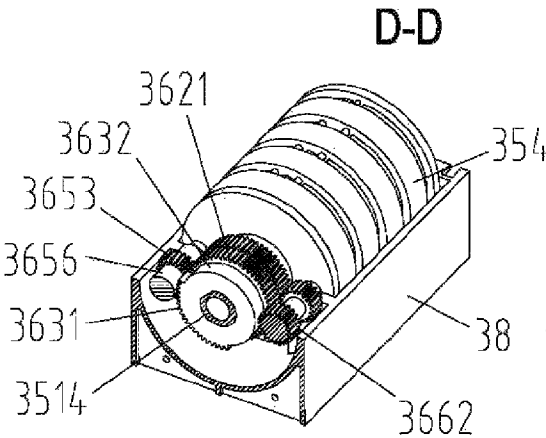
Figure 35E:
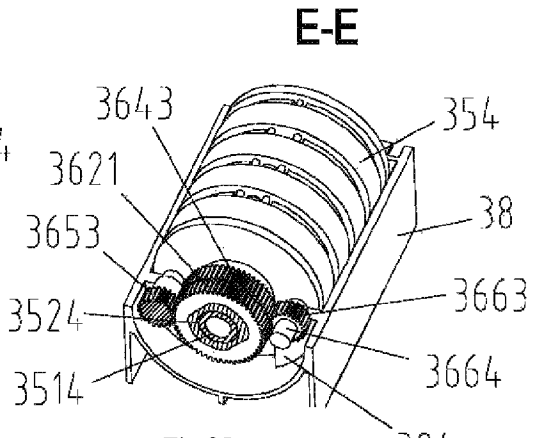
Figure 35F:
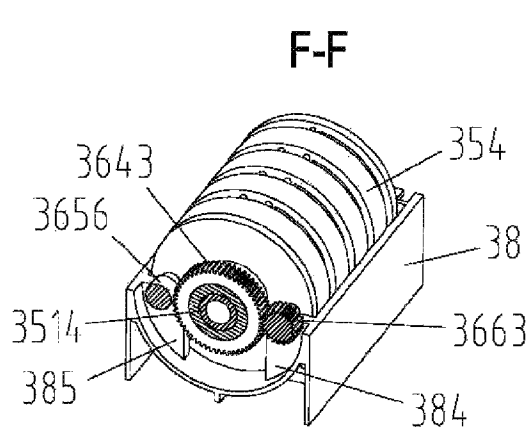
Figure 35G:
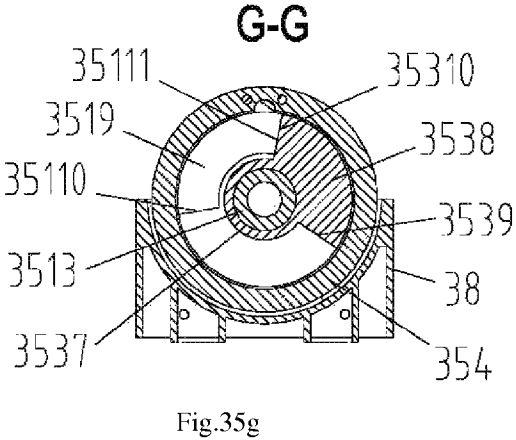
Figure 35H:
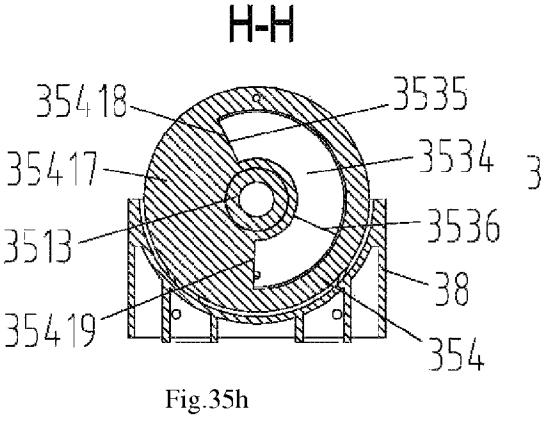
Figure 35I:
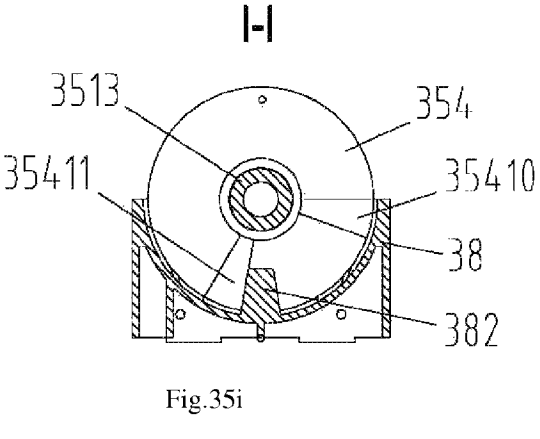

When the hollow rotating shaft 3513 of the first secondary roller 351 is rotated in the clockwise direction as shown in FIG. 34*g*, until the first secondary roller 351 rotates to the position where the end wall 35111 of the sector bulge 3519 is touched with the end wall 35310 of the sector bulge 3538 of the second secondary roller 352 (as shown in FIG. 35*g*), the front and rear cords 811 and 812 of the first secondary ladder tape 81 of the first secondary louver blade 91 are wound by the first secondary roller 351, and the front and rear cords 821 and 822 of the second secondary ladder tape 82 of the second secondary louver blade 92 are wound by the second secondary roller 352, such that the first secondary louver blade 91 and the second secondary louver blade 92 leave from the position where they are superposed with the third secondary louver blade 93 and horizontally rises an altitude $D_2$ relative to the primary louver blade 90, but the third secondary louver blade 93 is still at the position where it is superposed with the primary louver blade 90 (as shown in FIG. 40*b*). During this rotating process, the first secondary gear 361 jogged with the hollow rotating shaft 3514 of the first secondary roller 351 is rotated in the anti-clockwise direction as shown in FIG. 34*a*, the outer ring teeth 3611 of the first secondary gear 361 are meshed with the teeth 3652 of the second secondary driven gear 365 (as shown in FIG. 35*a*), the teeth 3653 of the second secondary driven gear 365 is meshed with the teeth 3621 of the second secondary gear 362 (as shown in FIG. 35*e*), and the outer ring arc surface 3612 of the first secondary gear 361 is not matched with the locking arc 3655 of the disc 3651 of the second secondary driven gear 365 (as shown in FIG. 35*b*). The outer ring arc surface 3632 of the third secondary gear 363 is always kept matched with the locking arc 3665 of the disc 3661 of the third secondary driven gear 366 (as shown in FIG. 35*c*), such that the third secondary driven gear 366 and the turning disc 364 are kept still together with the turning cylinder 354 (as shown in FIG. 35*f*).

Figure 36A:
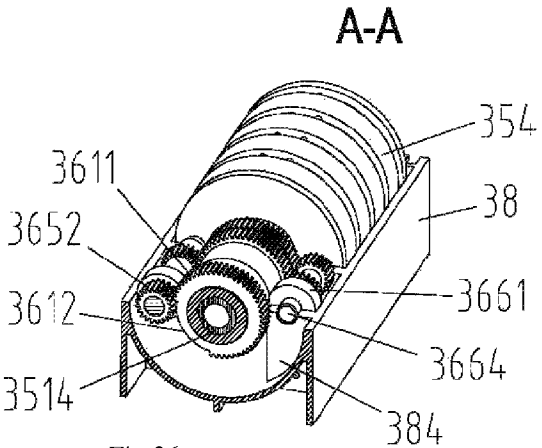
FIG. 36 shows nine sectional views of the roller system 3 of the pitch-variable combinatorial louver with three secondary louver blades (dual binary pitch) in the state before turning of louver blades.
Figure 36B:
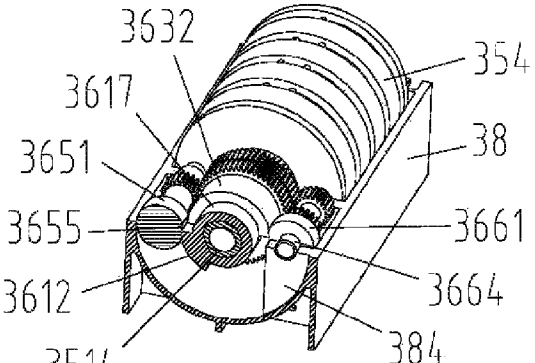
Figure 36C:
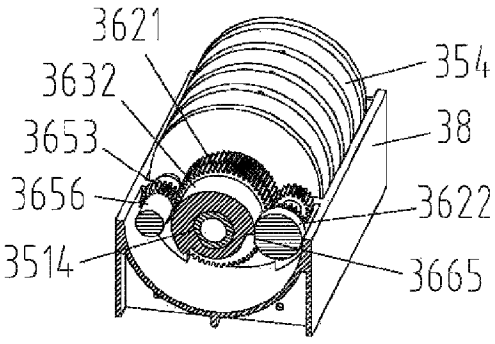
Figure 36D:
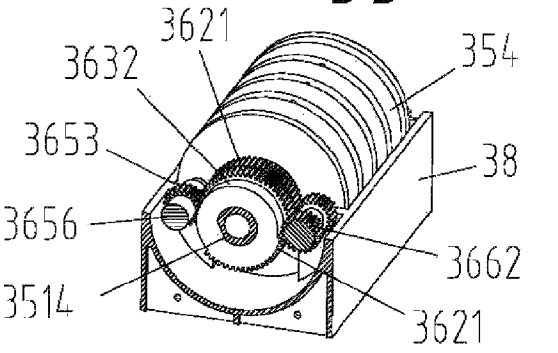
Figure 36E:
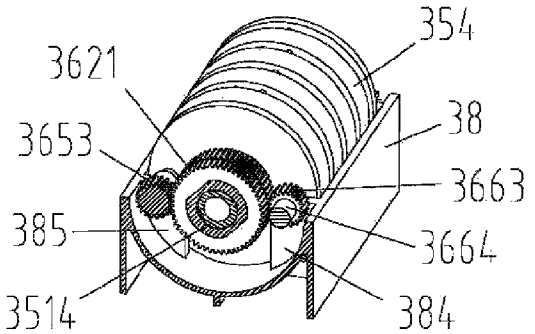
Figure 36F:
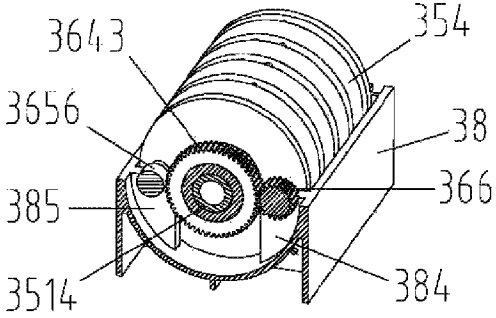
Figure 36I:
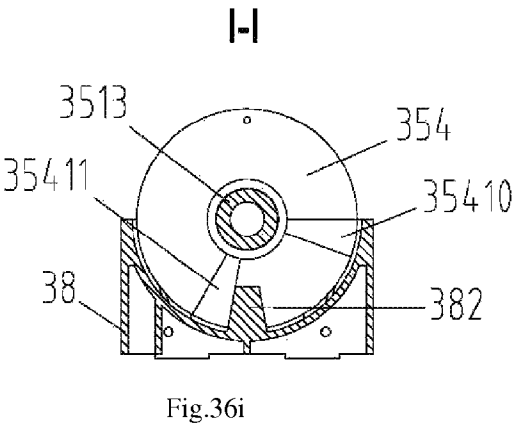
Figure 36H:
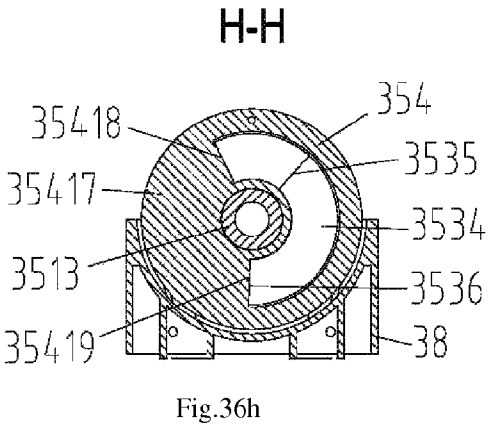
Figure 36G:
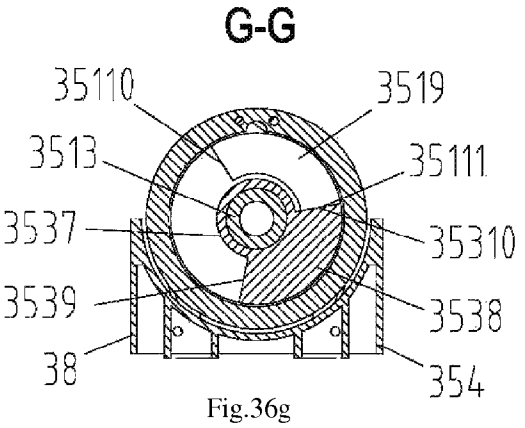

After the end wall 35111 of the sector bulge 3519 of the first secondary roller 351 is touched with the end wall 35310 of the sector bulge 3538 of the third secondary roller 353, the first secondary roller 351 continues to rotate (as shown in FIG. 36*g*). When the end wall 35111 of the sector bulge 3519 of the first secondary roller 351 is pressed against the end wall 35310 of the third secondary roller 353 and pushes the third secondary roller 353 to rotate to the position where the end wall 3536 of its sector bulge 3534 is touched with the end wall 35419 of the sector bulge 35417 on the inner wall of the closed end surface of the turning cylinder 354 (as shown in FIG. 36*h*), the front and rear cords 811 and 812 of the first secondary ladder tape 81 of the first secondary louver blade 91 are wound by the first secondary roller 351, and the front and rear cords 831 and 832 of the third secondary ladder tape 83 of the third secondary louver blade 93 are wound by the third secondary roller 353, such that the first secondary louver blade 91 and the third secondary louver blade 93 horizontally rise an altitude $D_3$ relative to the primary louver blade 90 simultaneously (as shown in FIG. 40*c*). During this rotating process, the first secondary gear 361 is rotated in the anti-clockwise direction as shown in FIG. 36*a*, and its outer ring teeth 3611 are not meshed with the teeth 3651 of the second secondary driven gear 365 all the way (as shown in FIG. 36*a*). But the outer ring arc surface 3612 of the first secondary gear 361 is always kept matched with the locking arc 3655 of the disc 3651 of the second secondary driven gear 365 (as shown in FIG. 36*b*), thus the driven gear 365 is locked and the second secondary gear 362 is kept still (as shown in FIG. 36*e*).

Figure 37C:
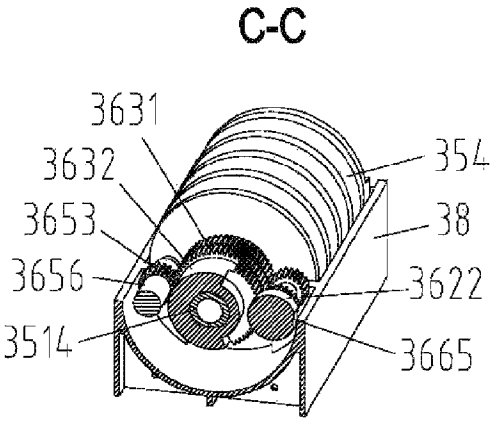
FIG. 37 shows nine sectional views of the roller system 3 of the pitch-variable combinatorial louver with three secondary louver blades (dual binary pitch) after turning and closing of louver blades.
Figure 37B:
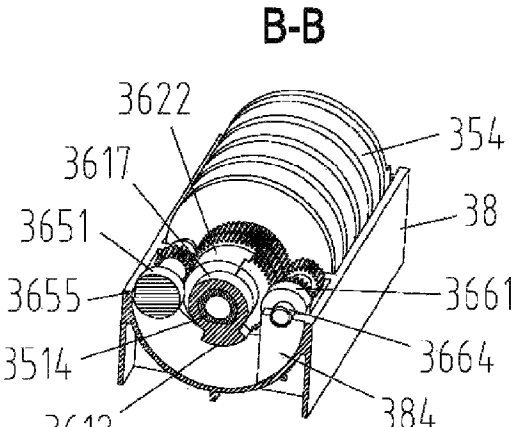
Figure 37A:
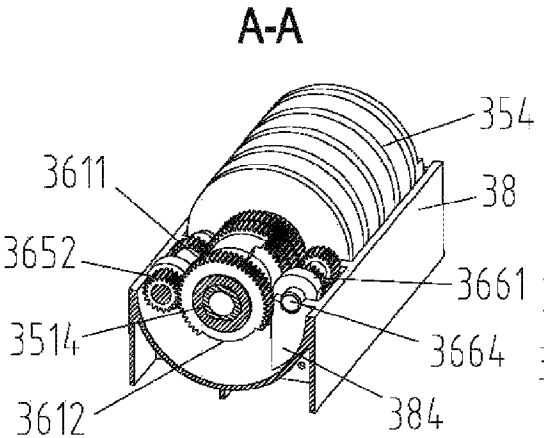
Figure 37D:
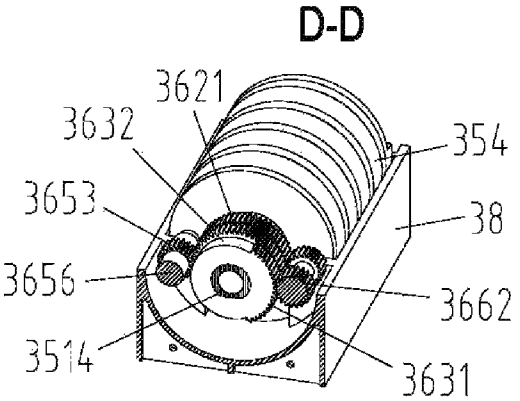
Figure 37E:
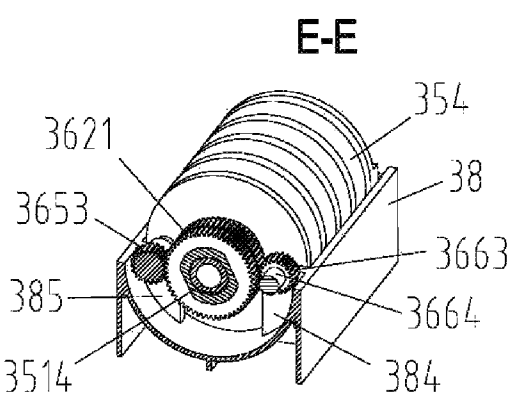
Figure 37F:
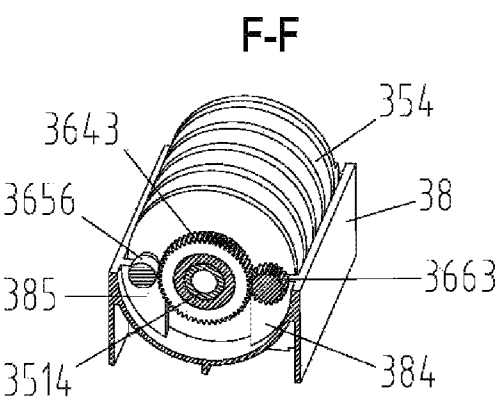
Figure 37G:
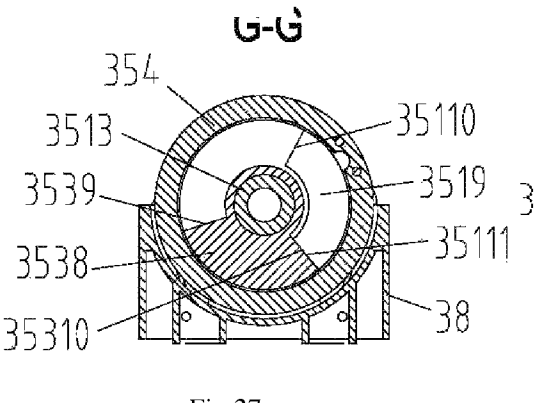
Figure 37H:
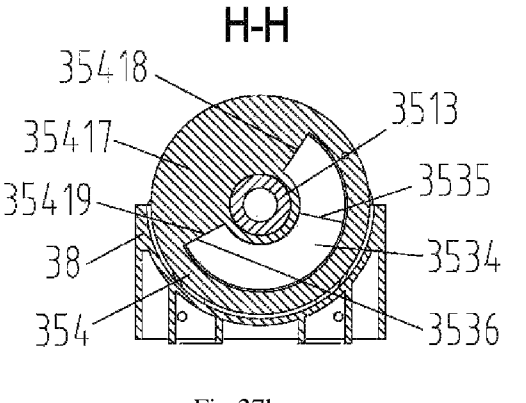
Figure 37I:
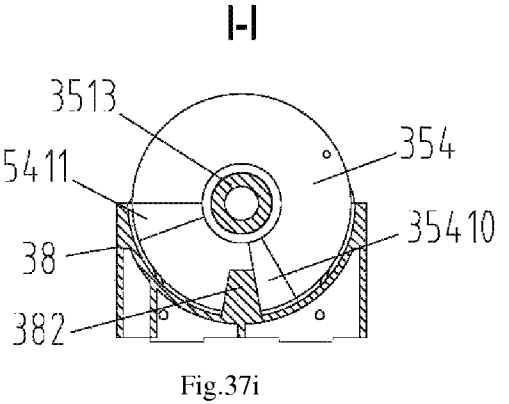
Figure 38A:
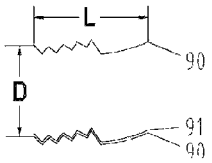
FIG. 38 is a cross-section schematic diagram of a combinatorial louver blade unit of a pitch-variable combinatorial louver with one secondary louver blade in which the secondary louver blade rises and falls relatively, and the primary and secondary louver blades turn over together.
Figure 38B:
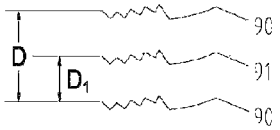
Figure 38C:
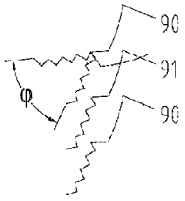

If the hollow rotating shaft 3513 of the first secondary roller 351 continues to be rotated, the side wall 36110 of the outer ring arc surface 3612 of the first secondary gear 361 starts to be detached from the locking arc 3655 of the disc 3651 of the second secondary driven gear 365 (as shown in FIG. 37*b*), the outer ring teeth of the first secondary gear 361 start to be meshed with the teeth 3652 of the second secondary driven gear 365 (as shown in FIG. 37*a*), and the teeth 3653 of the second secondary driven gear 365 is meshed with the teeth 3621 of the second secondary gear 362, so as to drive the second secondary gear 362 to rotate (as shown in FIG. 37*e*). Meanwhile, the outer ring teeth 3631 of the third secondary gear 363 are meshed with the teeth 3662 of the third secondary driven gear 366 (as shown in FIG. 37*d*), and the teeth 3663 of the third secondary driven gear 366 is meshed with the teeth 3643 of the turning disc 364 (as shown in FIG. 37*f*). During this rotating process, the end wall 35111 of the sector bulge 3519 of the first secondary roller 351 is pressed against the end wall 35310 of the sector bulge 3538 of the third secondary roller 353 and pushes the third secondary roller 353 to rotate (as shown in FIG. 37*g*), but the third secondary roller 353 rotates synchronously with the turning cylinder 354 while the end wall 3536 of its sector bulge 3534 is close to the end wall 35419 of the sector bulge 35417 on the inner wall of the closed end surface of the turning cylinder 354 (as shown in FIG. 37*h*). The turning cylinder 354 rotates until the sector bulge 35410 on its closed end surface is close to the bulge 382 of the base 38 (as shown in FIG. 37*i*); the front and rear cords 811 and 812 of the first secondary ladder tape 81 of the first secondary louver blade 91 are wound by the first secondary roller 351, the front and rear cords 821 and 822 of the second secondary ladder tape 82 of the second secondary louver blade 92 are wound by the second secondary roller 352, the front and rear cords 831 and 832 of the third secondary ladder tape 83 of the third secondary louver blade 93 are wound by the third secondary roller 353, and the front and rear cords 801 and 802 of the primary ladder tape 80 of the primary louver blade 90 are wound by the turning cylinder 354, such that the primary and secondary louver blades 9 turn $\phi$ simultaneously (as shown in FIG. 40*d*).

When the first secondary louver blade 91 and the second secondary louver blade 92 complete relative rising and turn to the closed position together with the primary louver blade 90 along with the turning cylinder 354, the hollow rotating shaft 3513 of the first secondary roller 351 is rotated reversely, then the primary and secondary louver blades 9 are withdrawn in the original order. Namely, first the primary and secondary louver blades 9 simultaneously turn to a horizontal position as shown in FIG. 39*c*, while the primary and secondary louver blades 9 turn to the horizontal position, the first secondary roller 351 does not apply acting force on the second secondary roller 352 no longer, the first secondary gear 361 jogged with the hollow rotating shaft 3514 of the first secondary roller 351 rotates in the clockwise direction as shown in FIG. 18*a*, the outer ring arc surface 3612 of the first secondary gear 361 is not touched with the locking arc 3655 of the disc 3651 of the driven gear 365, but the outer ring teeth 3611 of the first secondary gear 361 are meshed with the teeth 3652 of the driven gear 365, and the teeth 3652 of the driven gear 365 is meshed with the teeth 3643 of the turning disc 364, so as to drive the turning cylinder 354 to rotate in the clockwise direction as shown in FIG. 18*a*, and the end wall 35418 of the sector bulge 35417 on the inner wall of the closed end surface of the turning cylinder 354 is pressed against the end wall 3525 of the sector bulge 3524 of the second secondary roller 352, to allow it to reversely rotate together until the primary and secondary louver blades 9 turn to the horizontal position. When the primary and secondary louver blades 9 turn to the horizontal position, the outer ring arc surface 3612 of the first secondary gear 361 starts to be matched with the locking arc 3655 of the disc 3651 of the driven gear 365, meanwhile the outer ring teeth 3611 of the first secondary gear 361 starts to be detached from the teeth 3652 of the driven gear 365 and the turning cylinder 354 is locked.

The hollow rotating shaft 3513 of the first secondary roller 351 continues to rotate reversely, the first secondary roller 351 has no reverse pushing effect on the second secondary roller 352 and the second secondary roller 352 is rotated reversely under the gravity of the second secondary base rail 102 and the second secondary louver blade 92 delivered by the second secondary ladder tape 82, but the end wall 35210 of the sector bulge 3528 of the second secondary roller 352 is obstructed by the end wall 35111 of the sector bulge 3519 of the first secondary roller 351 all the way while the second secondary louver blade 92 and the second secondary base rail 102 fall down, such that the second secondary roller 352 rotates all the way along with the first secondary roller 351 reversely, until the second secondary louver blade 92 is superposed on the primary louver blade 90. Up to this point, the first secondary louver blade 91 and the second secondary louver blade 92 have fell an altitude $D_2$ relative to the primary louver blade 90 (as shown in FIG. 39*b*), meanwhile the end wall 3526 of the sector bulge 3524 of the second secondary roller 352 is propped against the end wall 35419 of the sector bulge 35417 on the inner wall of the closed end surface of the turning cylinder 354 without the probability of turning back.

The hollow rotating shaft 3513 of the first secondary roller 351 continues to rotate reversely until the first secondary louver blade 91 fall to the position where it is superposed with the second secondary louver blade 92 as shown in FIG. 39*a*, the first secondary roller 351 turns back to the initial position. At this point, the end wall 35110 of the sector bulge 3518 of the first secondary roller 351 is propped by the end wall 3529 of the sector bulge 3528 of the second secondary roller 352, the end wall 3525 of the sector bulge 3524 of the second secondary roller 352 is propped by the end wall 35419 of the sector bulge 35417 on the inner wall of the closed end surface of the turning cylinder 354, and the sector bulge 35411 on the closed end surface of the turning cylinder 354 is propped by the bulge 382 of the base 38, such that the first secondary roller 351 can not continue to rotate reversely (as shown in FIG. 15).

Figure 41A:
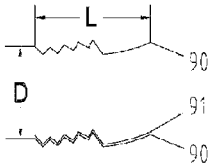
FIG. 41 is a cross-section schematic diagram of a combinatorial louver blade unit of a pitch-variable combinatorial louver with one secondary louver blade in which the secondary louver blade rises and falls relatively, the primary louver blade keeps horizontal, and the secondary louver blade turns over relative to the primary louver blade.
Figure 41B:
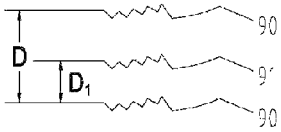
Figure 41C:
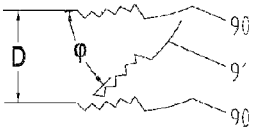
Figure 42A:
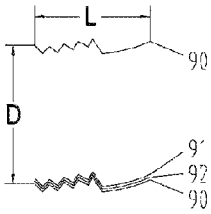
FIG. 42 is a cross-section schematic diagram of a combinatorial louver blade unit of a pitch-variable combinatorial louver with two secondary louver blades in which the secondary louver blades rise and fall relatively, the primary louver blade keeps horizontal, and the secondary louver blades turn over relative to the primary louver blade.
Figure 42B:
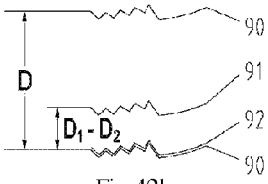
Figure 42C:
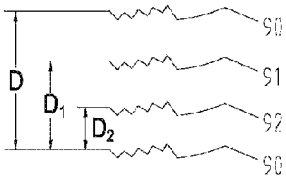
Figure 42D:
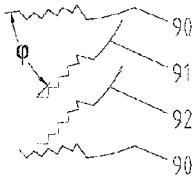
Figure 43A:
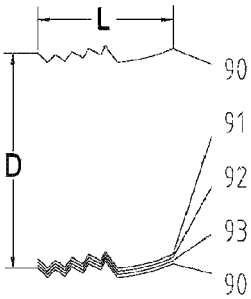
FIG. 43 is a cross-section schematic diagram of a combinatorial louver blade unit of a pitch-variable combinatorial louver with three secondary louver blades (dual binary pitch) in which the secondary louver blades rise and fall relatively, the primary louver blade keeps horizontal, and the secondary louver blades turn over relative to the primary louver blade.
Figure 43B:
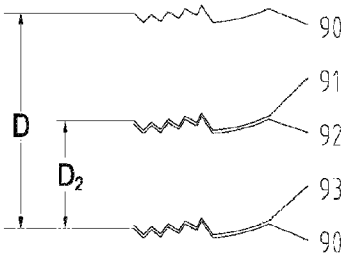
Figure 43C:
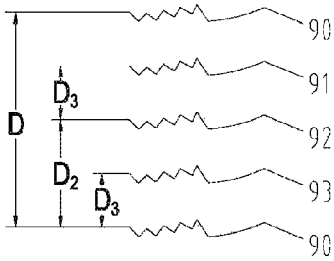
Figure 43D:
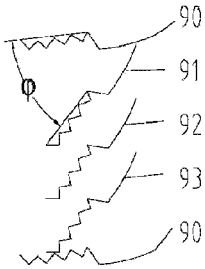

In the roller system described above, only if the upper end of the primary ladder tape 80 fixed in the annular groove 3544 of the turning cylinder 354 is fixed on the top rail 1, it can be applied to the roller system of the pitch-variable combinatorial louver with one secondary louver blade (as shown in FIG. 41), the roller system of the pitch-variable combinatorial louver with two secondary louver blades (as shown in FIG. 42) and the roller system of the pitch-variable combinatorial louver with three secondary louver blades (as shown in FIG. 43).

The principles of the roller system described above can also be extended to the pitch-variable combinatorial louver with more than four secondary louver blades.

In a word, the foregoing is preferred embodiments of the invention only, and equivalent changes and modifications made according to the application scope of the invention should be encompassed within the scope of the invention.

What is claimed is:

1. A louver roller system, comprising:

a base, a top cover covering the base, a roller mechanism, wherein the roller mechanism comprises a turning cylinder having an open end and a closed end, and a roller assembly arranged within the turning cylinder; wherein the roller assembly comprises at least one secondary roller; and a turning mechanism having a turning disc provided at the open end of the turning cylinder, wherein one side of a driven gear is engaged with the turning disc and the other side of the driven gear is engaged with an intermittent gear assembly having at least one intermittent gear a ladder tape assembly having a primary ladder tape and a secondary ladder tape;

a louver blade assembly having a primary louver blade and a secondary louver blade; and a square shaft configured to rotate the roller mechanism and the turning mechanism;

wherein a hollow rotating shaft is extended out from both sides of the secondary roller with one end being attached to the turning cylinder and the other end passing through the turning disc and connecting to the intermittent gear, such that the roller mechanism is coaxially aligned with the turning mechanism;

wherein the roller mechanism and the turning mechanism are enclosed by the base and the top cover;

wherein the secondary roller is wound with the secondary ladder tape and the secondary ladder tape is connected with the secondary louver blade, such that the rotation of the secondary roller leads to the wind or unwind of the secondary ladder tape and therefore the up or down movement of the secondary louver blade;

wherein the turning mechanism is configured to turn the louver blade assembly, including the primary louver blade and the secondary louver blade, when the louver blade assembly is elevated to a predetermined position.

2. The louver roller system according to claim 1, wherein the secondary louver blade comprises a first secondary blade and a second secondary blade; the secondary roller comprises a first secondary roller and a second roller; the secondary ladder tape comprises a first secondary ladder tape and a second secondary ladder tape;

wherein the turning cylinder further comprises a first annular groove, a second annular groove and a third annular groove provided on an outer surface of the turning cylinder; wherein the first and second annular groove each is provided with a hole on the top and two first pin shafts are mounted at both sides of the hole, such that an upper end of a front cord of the first and second secondary ladder tapes and an upper end of a rear cord of the first and second secondary ladder tapes pass through the hole between the two pin shafts on each of the first and second annular grooves, entering into the turning cylinder and being attached to the first and second secondary rollers, respectively; the third annular groove is provided with a pin hole on the top, and is wound with the primary ladder tape; an upper end of a front cord of the primary ladder tape and an upper end of a rear cord of the primary ladder tape are anchored to the top of the third annular groove by means of a second pin shaft;

a first sector bulge and a second sector bulge are axially extended out from an outer wall of the closed end of the turning cylinder for controlling rotation angle of the turning cylinder; in operation, the turning cylinder is rotated until the first sector bulge thereof contacts with a base bulge of the base;

when the turning cylinder is rotated reversely, an annular bulge axially extending from an inner wall of the closed end of the turning cylinder actuates the reverse rotation of the second secondary roller, enabling the second secondary louver blade to back to a horizontal position.

3. The louver roller system according to claim 1, wherein a first annular disc of the first secondary roller with one side being planar and the other side having a third sector budge axially extending therefrom is provided on the hollow rotating shaft; two sides of a second annular disc of the second roller having a fourth sector budge and a fifth sector budge axially extending therefrom.

4. The louver roller system according to claim 1, wherein one side of the turning disc is planar and three sector convex platforms are provided thereon; wherein a fixed gear with a neck journal is provided on the other side of the turning disc and engaged with the driven gear.

5. The louver roller system according to claim 1, wherein the outer surface of the intermittent gear comprises two portions including a toothed portion and an arc surface.

6. The louver roller system according to claim 1, wherein the driven gear comprises at least one gear portion and a disc having a locking arc.

7. The louver roller system according to claim 2, wherein the first secondary roller and the second secondary roller are provided within the turning cylinder, and the hollow rotating shaft is extended through the first secondary roller; wherein the second roller is joined to the hollow rotating shaft in muff-coupling; the hollow rotating shaft passes through the turning disc and fit with an inner ring of the intermittent gear; the driven gear is arranged beside the intermittent gear such that the driven gear is engaged with the intermittent gear and the fixed gear in the center of the turning disc;

the hollow rotating shaft and the first secondary roller are rotated by the square shaft, and the rotation of the first secondary roller leads to the elevation of the first secondary louver blade by winding the first secondary ladder tape;

once the first secondary louver blade is elevated by $D_1$–$D_2$, the third sector bulge of the first secondary roller acts against the fourth sector bulge of the second roller and enables the rotation of the second secondary roller; the rotation of the second secondary roller leads to the elevation of the second secondary louver blade along with the first secondary louver blade by winding the second secondary ladder tapes;

the intermittent gear is rotated with the hollow rotating shaft; once the second secondary louver blade is elevated by $D_2$, the intermittent gear actuates the rotation of the turning disc and the turning cylinder through the driven gear, and therefore achieving the turning of all louver blades;

wherein $D_1$ is a vertical distance between the first secondary louver blade and the primary louver blade beneath, and $D_2$ is a vertical distance between the second secondary louver blade and the primary louver blade beneath.

8. The louver roller system according to claim 2, wherein the roller assembly further comprises a third secondary roller, and the intermittent gear assembly further comprises a second gear and a third gear;

wherein the third secondary roller is also provided within the turning cylinder; the second secondary roller and the third secondary roller are jointed to the hollow rotating shafts in muff-coupling with the first secondary roller being positioned between them; the hollow rotating shaft passes through the turning disc, the second gear and the intermittent gear; the second roller comprises a second hollow rotating shaft extending from one side of the second secondary roller opposite to the first roller, and the second gear is secured to the second hollow rotating shaft of the second secondary roller; the first gear and the third gear are secured on the hollow rotating shaft extending through the first secondary roller; both sides of the intermittent gear are provided with a second driven gear and a third driven gear; the hollow rotating shaft of the first roller is rotated by the square shaft, leading to the rotation of the first secondary roller, intermittent gear and the third gear; the second gear is synchronously rotated with the intermittent gear through the second driven gear, that is, the second gear actuates the rotation of the second secondary roller synchronous with the first secondary roller until the second secondary louver blade is elevated by $D_2$ along with the first secondary louver blade; in this case, the third sector bulge abuts against a sixth sector bulge of the third secondary roller, such that when the first secondary roller winds up the first secondary ladder tape, the second secondary roller keeps stationary; at the same time the first secondary roller actuates the rotation of the third secondary roller to wind up the third secondary ladder tape until the third secondary louver blade is elevated by $D_3$ along with the first secondary louver blade;

the fixed gear of the turning disc is rotated along with the third gear via the third driven gear once the third gear is rotated by a certain angle, in this case the first roller, the second roller, the third roller are rotated along with the turning disc as well; the turning disc enables the rotation of the turning cylinder and leads to the turning of the louver blade assembly;

wherein $D_2$ is a vertical distance between the second secondary louver blade and the primary louver blade beneath, wherein $D_3$ is a vertical distance between the third secondary louver blade and the primary louver blade beneath.

9. The louver roller system according to claim 8, wherein the second driven gear and the third driven gear each comprises two gear portions and a disc with locking arc; one gear portion of the second driven gear is engaged with the second gear, and the other one is engaged with the intermittent gear; one gear portion of the third driven gear is engaged with the fixed gear of the turning disc, and the other one is engaged with the third gear.

10. The louver roller system according to claim 3, wherein the first secondary roller and the second secondary roller are provided within the turning cylinder, and the hollow rotating shaft is extended through the first secondary roller; wherein the second roller is joined to the hollow rotating shaft in muff-coupling; the hollow rotating shaft passes through the turning disc and fit with an inner ring of the intermittent gear; the driven gear is arranged beside the intermittent gear such that the driven gear is engaged with the intermittent gear and the fixed gear in the center of the turning disc;

the hollow rotating shaft and the first secondary roller are rotated by the square shaft, and the rotation of the first secondary roller leads to the elevation of the first secondary louver blade by winding the first secondary ladder tape;

once the first secondary louver blade is elevated by $D_1-D_2$, the third sector bulge of the first secondary roller acts against the fourth sector bulge of the second roller and enables the rotation of the second secondary roller; the rotation of the second secondary roller leads to the elevation of the second secondary louver blade along with the first secondary louver blade by winding the second secondary ladder tapes;

the intermittent gear is rotated with the hollow rotating shaft; once the second secondary louver blade is elevated by $D_2$, the intermittent gear actuates the rotation of the turning disc and the turning cylinder through the driven gear, and therefore achieving the turning of all louver blades;

wherein $D_1$ is a vertical distance between the first secondary louver blade and the primary louver blade beneath, and $D_2$ is a vertical distance between the second secondary louver blade and the primary louver blade beneath.

11. The louver roller system according to claim 4, wherein the first secondary roller and the second secondary roller are provided within the turning cylinder, and the hollow rotating shaft is extended through the first secondary roller; wherein the second roller is joined to the hollow rotating shaft in muff-coupling; the hollow rotating shaft passes through the turning disc and fit with an inner ring of the intermittent gear; the driven gear is arranged beside the intermittent gear such that the driven gear is engaged with the intermittent gear and the fixed gear in the center of the turning disc;

the hollow rotating shaft and the first secondary roller are rotated by the square shaft, and the rotation of the first secondary roller leads to the elevation of the first secondary louver blade by winding the first secondary ladder tape;

once the first secondary louver blade is elevated by $D_1-D_2$, the third sector bulge of the first secondary roller acts against the fourth sector bulge of the second roller and enables the rotation of the second secondary roller; the rotation of the second secondary roller leads to the elevation of the second secondary louver blade along with the first secondary louver blade by winding the second secondary ladder tapes;

the intermittent gear is rotated with the hollow rotating shaft; once the second secondary louver blade is elevated by $D_2$, the intermittent gear actuates the rotation of the turning disc and the turning cylinder through the driven gear, and therefore achieving the turning of all louver blades;

wherein $D_1$ is a vertical distance between the first secondary louver blade and the primary louver blade beneath, and $D_2$ is a vertical distance between the second secondary louver blade and the primary louver blade beneath.

12. The louver roller system according to claim 5, wherein the first secondary roller and the second secondary roller are provided within the turning cylinder, and the hollow rotating shaft is extended through the first secondary roller; wherein the second roller is joined to the hollow rotating shaft in muff-coupling; the hollow rotating shaft passes through the turning disc and fit with an inner ring of the intermittent gear; the driven gear is arranged beside the intermittent gear such that the driven gear is engaged with the intermittent gear and the fixed gear in the center of the turning disc;

the hollow rotating shaft and the first secondary roller are rotated by the square shaft, and the rotation of the first secondary roller leads to the elevation of the first secondary louver blade by winding the first secondary ladder tape;

once the first secondary louver blade is elevated by $D_1-D_2$, the third sector bulge of the first secondary roller acts against the fourth sector bulge of the second roller and enables the rotation of the second secondary roller; the rotation of the second secondary roller leads to the elevation of the second secondary louver blade along with the first secondary louver blade by winding the second secondary ladder tapes;

the intermittent gear is rotated with the hollow rotating shaft; once the second secondary louver blade is elevated by $D_2$, the intermittent gear actuates the rotation of the turning disc and the turning cylinder through the driven gear, and therefore achieving the turning of all louver blades;

wherein $D_1$ is a vertical distance between the first secondary louver blade and the primary louver blade beneath, and $D_2$ is a vertical distance between the second secondary louver blade and the primary louver blade beneath.

13. The louver roller system according to claim 6, wherein the first secondary roller and the second secondary roller are provided within the turning cylinder, and the hollow rotating shaft is extended through the first secondary roller; wherein the second roller is joined to the hollow rotating shaft in muff-coupling; the hollow rotating shaft passes through the turning disc and fit with an inner ring of the intermittent gear; the driven gear is arranged beside the intermittent gear such that the driven gear is engaged with the intermittent gear and the fixed gear in the center of the turning disc;

the hollow rotating shaft and the first secondary roller are rotated by the square shaft, and the rotation of the first secondary roller leads to the elevation of the first secondary louver blade by winding the first secondary ladder tape;

once the first secondary louver blade is elevated by $D_1-D_2$, the third sector bulge of the first secondary roller acts against the fourth sector bulge of the second roller and enables the rotation of the second secondary roller; the rotation of the second secondary roller leads to the elevation of the second secondary louver blade along with the first secondary louver blade by winding the second secondary ladder tapes;

the intermittent gear is rotated with the hollow rotating shaft; once the second secondary louver blade is elevated by $D_2$, the intermittent gear actuates the rotation of the turning disc and the turning cylinder through the driven gear, and therefore achieving the turning of all louver blades;

wherein $D_1$ is a vertical distance between the first secondary louver blade and the primary louver blade beneath, and $D_2$ is a vertical distance between the second secondary louver blade and the primary louver blade beneath.

14. The louver roller system according to claim 3, wherein the roller assembly further comprises a third secondary roller, and the intermittent gear assembly further comprises a second gear and a third gear;

wherein the third secondary roller is also provided within the turning cylinder; the second secondary roller and the third secondary roller are jointed to the hollow rotating shafts in muff-coupling with the first secondary roller being positioned between them; the hollow rotating shaft passes through the turning disc, the second gear and the intermittent gear; the second roller comprises a second hollow rotating shaft extending from one side of the second secondary roller opposite to the first roller, and the second gear is secured to the second hollow rotating shaft of the second secondary roller; the first gear and the third gear are secured on the hollow rotating shaft extending through the first secondary roller; both sides of the intermittent gear are provided with a second driven gear and a third driven gear; the hollow rotating shaft of the first roller is rotated by the square shaft, leading to the rotation of the first secondary roller, the intermittent gear and the third gear; the second gear is synchronously rotated with the intermittent gear through the second driven gear, that is, the second gear actuates the rotation of the second secondary roller synchronous with the first secondary roller until the second secondary louver blade is elevated by $D_2$ along with the first secondary louver blade; in this case, the third sector bulge abuts against a sixth sector bulge of the third secondary roller, such that when the first secondary roller winds up the first secondary ladder tape, the second secondary roller keeps stationary; at the same time the first secondary roller actuates the rotation of the third secondary roller to wind up the third secondary ladder tape until the third secondary louver blade is elevated by $D_3$ along with the first secondary louver blade;

the fixed gear of the turning disc is rotated along with the third gear via the third driven gear once the third gear is rotated by a certain angle, in this case the first roller, the second roller, the third roller are rotated along with the turning disc as well; the turning disc enables the rotation of the turning cylinder and leads to the turning of the louver blade assembly;

wherein $D_2$ is a vertical distance between the second secondary louver blade and the primary louver blade beneath, wherein $D_3$ is a vertical distance between the third secondary louver blade and the primary louver blade beneath.

15. The louver roller system according to claim 4, wherein the roller assembly further comprises a third secondary roller, and the intermittent gear assembly further comprises a second gear and a third gear;

wherein the third secondary roller is also provided within the turning cylinder; the second secondary roller and the third secondary roller are jointed to the hollow rotating shafts in muff-coupling with the first secondary roller being positioned between them; the hollow rotating shaft passes through the turning disc, the second gear and the intermittent gear; the second roller comprises a second hollow rotating shaft extending from one side of the second secondary roller opposite to the first roller, and the second gear is secured to the second hollow rotating shaft of the second secondary roller; the first gear and the third gear are secured on the hollow rotating shaft extending through the first secondary roller; both sides of the intermittent gear are provided with a second driven gear and a third driven gear; the hollow rotating shaft of the first roller is rotated by the square shaft, leading to the rotation of the first secondary roller, the intermittent gear and the third gear; the second gear is synchronously rotated with the intermittent gear through the second driven gear, that is, the second gear actuates the rotation of the second secondary roller synchronous with the first secondary roller until the second secondary louver blade is elevated by $D_2$ along with the first secondary louver blade; in this case, the third sector bulge abuts against a sixth sector bulge of the third secondary roller, such that when the first secondary roller winds up the first secondary ladder tape, the second secondary roller keeps stationary; at the same time the first secondary roller actuates the rotation of the third secondary roller to wind up the third secondary ladder tape until the third secondary louver blade is elevated by $D_3$ along with the first secondary louver blade;

the fixed gear of the turning disc is rotated along with the third gear via the third driven gear once the third gear is rotated by a certain angle, in this case the first roller, the second roller, the third roller are rotated along with the turning disc as well; the turning disc enables the rotation of the turning cylinder and leads to the turning of the louver blade assembly;

wherein $D_2$ is a vertical distance between the second secondary louver blade and the primary louver blade beneath, wherein $D_3$ is a vertical distance between the third secondary louver blade and the primary louver blade beneath.

16. The louver roller system according to claim 5, wherein the roller assembly further comprises a third secondary roller, and the intermittent gear assembly further comprises a second gear and a third gear;

wherein the third secondary roller is also provided within the turning cylinder; the second secondary roller and the third secondary roller are jointed to the hollow rotating shafts in muff-coupling with the first secondary roller being positioned between them; the hollow rotating shaft passes through the turning disc, the second gear and the intermittent gear; the second roller comprises a second hollow rotating shaft extending from one side of the second secondary roller opposite to the first roller, and the second gear is secured to the second hollow rotating shaft of the second secondary roller; the first gear and the third gear are secured on the hollow rotating shaft extending through the first secondary roller; both sides of the intermittent gear are provided with a second driven gear and a third driven gear; the hollow rotating shaft of the first roller is rotated by the square shaft, leading to the rotation of the first secondary roller, the intermittent gear and the third gear; the second gear is synchronously rotated with the intermittent gear through the second driven gear, that is, the second gear actuates the rotation of the second secondary roller synchronous with the first secondary roller until the second secondary louver blade is elevated by $D_2$ along with the first secondary louver blade; in this case, the third sector bulge abuts against a sixth sector bulge of the third secondary roller, such that when the first secondary roller winds up the first secondary ladder tape, the second secondary roller keeps stationary; at the same time the first secondary roller actuates the rotation of the third secondary roller to wind up the third secondary ladder tape until the third secondary louver blade is elevated by $D_3$ along with the first secondary louver blade;

the fixed gear of the turning disc is rotated along with the third gear via the third driven gear once the third gear is rotated by a certain angle, in this case the first roller, the second roller, the third roller are rotated along with the turning disc as well; the turning disc enables the rotation of the turning cylinder and leads to the turning of the louver blade assembly;

wherein $D_2$ is a vertical distance between the second secondary louver blade and the primary louver blade beneath, wherein $D_3$ is a vertical distance between the third secondary louver blade and the primary louver blade beneath.

17. The louver roller system according to claim 6, wherein the roller assembly further comprises a third secondary roller, and the intermittent gear assembly further comprises a second gear and a third gear;

wherein the third secondary roller is also provided within the turning cylinder; the second secondary roller and the third secondary roller are jointed to the hollow rotating shafts in muff-coupling with the first secondary roller being positioned between them; the hollow rotating shaft passes through the turning disc, the second gear and the intermittent gear; the second roller comprises a second hollow rotating shaft extending from one side of the second secondary roller opposite to the first roller, and the second gear is secured to the second hollow rotating shaft of the second secondary roller; the first gear and the third gear are secured on the hollow rotating shaft extending through the first secondary roller; both sides of the intermittent gear are provided with a second driven gear and a third driven gear; the hollow rotating shaft of the first roller is rotated by the square shaft, leading to the rotation of the first secondary roller, the intermittent gear and the third gear; the second gear is synchronously rotated with the intermittent gear through the second driven gear, that is, the second gear actuates the rotation of the second secondary roller synchronous with the first secondary roller until the second secondary louver blade is elevated by $D_2$ along with the first secondary louver blade; in this case, the third sector bulge abuts against a sixth sector bulge of the third secondary roller, such that when the first secondary roller winds up the first secondary ladder tape, the second secondary roller keeps stationary; at the same time the first secondary roller actuates the rotation of the third secondary roller to wind up the third secondary ladder tape until the third secondary louver blade is elevated by $D_3$ along with the first secondary louver blade;

the fixed gear of the turning disc is rotated along with the third gear via the third driven gear once the third gear is rotated by a certain angle, in this case the first roller, the second roller, the third roller are rotated along with the turning disc as well; the turning disc enables the rotation of the turning cylinder and leads to the turning of the louver blade assembly;

wherein $D_2$ is a vertical distance between the second secondary louver blade and the primary louver blade beneath, wherein $D_3$ is a vertical distance between the third secondary louver blade and the primary louver blade beneath.

* * * * *